US010857693B2

(12) United States Patent
Barber

(10) Patent No.: US 10,857,693 B2
(45) Date of Patent: Dec. 8, 2020

(54) SAWMILL WITH A ROCKING CARRIAGE

(71) Applicant: Jeff Barber, West Plains, MO (US)

(72) Inventor: Jeff Barber, West Plains, MO (US)

( * ) Notice: Subject to any disclaimer, the term of this patent is extended or adjusted under 35 U.S.C. 154(b) by 257 days.

(21) Appl. No.: 15/656,044

(22) Filed: Jul. 21, 2017

(65) Prior Publication Data

US 2018/0021972 A1 Jan. 25, 2018

Related U.S. Application Data

(60) Provisional application No. 62/375,614, filed on Aug. 16, 2016, provisional application No. 62/365,067, filed on Jul. 21, 2016.

(51) Int. Cl.

| | |
|---|---|
| ***B27B 13/04*** | (2006.01) |
| ***B27B 31/00*** | (2006.01) |
| ***B27B 33/06*** | (2006.01) |
| ***B27L 1/12*** | (2006.01) |

(52) U.S. Cl.

CPC ..... *B27B 13/04* (2013.01); *B27B 31/006* (2013.01); *B27B 33/06* (2013.01); *B27L 1/127* (2013.01)

(58) Field of Classification Search

CPC ..... B27B 13/00; B27B 13/02; B27B 13/04; B27B 31/00; B27B 31/006; B27B 33/00; B27B 33/02; B27B 33/04; B27B 33/06; B27B 33/08; B25B 1/00; B25B 1/18

USPC ..... 269/32, 291

See application file for complete search history.

(56) References Cited

U.S. PATENT DOCUMENTS

| | | | | | |
|---|---|---|---|---|---|
| 35,690 | A | | 6/1862 | Kimball | 83/718 |
| 106,932 | A | | 8/1870 | Gridley | 269/54.2 |
| 256,157 | A | | 4/1882 | Parker | 83/719 |
| 291,452 | A | | 1/1884 | Wilkin | 83/719 |
| 334,284 | A | | 1/1886 | Reamy | 83/728 |
| 553,351 | A | | 1/1896 | Matthews | 83/708 |
| 752,440 | A | | 2/1904 | Davies | 83/712 |
| 1,404,820 | A | | 1/1922 | Willette | 83/719 |
| 1,481,664 | A | | 1/1924 | Dickinson | 83/720 |
| 2,714,904 | A | * | 8/1955 | Bolton | B27B 13/04 83/811 |
| 3,464,467 | A | | 9/1969 | Meis | 83/728 |
| 3,557,848 | A | * | 1/1971 | Wright | B27B 13/10 83/169 |
| 3,739,679 | A | * | 6/1973 | Schwend | B23D 53/04 83/789 |
| 4,210,184 | A | * | 7/1980 | McGriff | B23D 47/005 125/13.01 |

(Continued)

OTHER PUBLICATIONS

Slideshow on 67 sheets, each sheet representing every 2 seconds of a video of a Band Mill of Woodland Sawmill Manufacturing, Inc., a Missouri corporation that resided in Van Buren, MO, and which existed between Jul. 17, 1998 and Aug. 2, 2001, wherein the video file is dated Mar. 2, 2016.

*Primary Examiner* — Andrea L Wellington
*Assistant Examiner* — Richard D Crosby, Jr.
(74) *Attorney, Agent, or Firm* — Jonathan A. Bay

(57) ABSTRACT

A sawmill for tree logs includes a rocking carriage to pick up fresh logs and feed them into the path of a saw blade, as well further provisions relating to improvements to infeed systems for the fresh logs, as well as to, outflow systems for transfer of sawn-off product to a production line conveyor or the like for further processing to downline processes after the first saw cuts on the fresh logs.

7 Claims, 22 Drawing Sheets

(56) References Cited

U.S. PATENT DOCUMENTS

| | | | | | |
|---|---|---|---|---|---|
| 4,281,696 | A * | 8/1981 | Howard | B27B 31/006 | 144/357 |
| 4,300,428 | A | 11/1981 | Woodland | B23Q 9/0064 | |
| 4,558,614 | A * | 12/1985 | Harris | B23D 53/08 | 83/56 |
| 4,941,382 | A | 7/1990 | Smith et al. | 83/713 | |
| 5,181,445 | A * | 1/1993 | Cothrell | B23D 59/001 | 144/24.16 |
| 5,806,401 | A | 9/1998 | Rajala et al. | 83/865 | |
| 6,220,423 | B1 * | 4/2001 | Gagnon | B27B 31/006 | 198/460.1 |
| 6,267,544 | B1 * | 7/2001 | Neville | B27B 29/00 | 144/242.1 |
| 6,550,605 | B1 * | 4/2003 | Therrien | B27B 31/006 | 198/413 |
| 7,444,912 | B2 * | 11/2008 | Fenton | B23D 45/024 | 144/1.1 |
| 2003/0154834 | A1 * | 8/2003 | Cothrell | B23D 59/001 | 83/435.2 |
| 2004/0084281 | A1 * | 5/2004 | Seffens | B27B 31/006 | 198/469.1 |
| 2006/0144675 | A1 * | 7/2006 | Mitchell | B27B 31/003 | 198/463.1 |
| 2007/0039664 | A1 * | 2/2007 | Quick | B27B 31/003 | 144/356 |
| 2010/0200118 | A1 * | 8/2010 | Krauss | B27B 31/006 | 144/357 |
| 2013/0037171 | A1 * | 2/2013 | O'Halloran | B02C 18/225 | 144/242.1 |
| 2014/0209213 | A1 * | 7/2014 | Doiel | B27B 1/007 | 144/356 |
| 2018/0021972 | A1 * | 1/2018 | Barber | B27B 13/04 | |

* cited by examiner

SAWMILL WITH A ROCKING CARRIAGE

CROSS-REFERENCE TO PROVISIONAL APPLICATION(S)

This application claims the benefit of U.S. Provisional Application No. 62/365,067, filed Jul. 21, 2016; and U.S. Provisional Application No. 62/375,614, filed Aug. 16, 2016. The foregoing patent disclosures are incorporated herein by this reference thereto.

BACKGROUND AND SUMMARY OF THE INVENTION

The invention relates to sawmills and, more particularly, to aspects related to increased automation thereof including without limitation a rocking carriage.

The invention alternatively more particularly relates to, for an inclined band mill (eg., an inclined band saw on a traversing carriage), certain further provisions relating to improvements to infeed systems of fresh logs, as well as, outflow systems for sawn-off product to a conveyor for further processing down a production line conveyor.

A number of additional features and objects will be apparent in connection with the following discussion of the preferred embodiments and examples with reference to the drawings.

BRIEF DESCRIPTION OF THE DRAWINGS

There are shown in the drawings certain exemplary embodiments of the invention as presently preferred. It should be understood that the invention is not limited to the embodiments disclosed as examples, and is capable of variation within the scope of the skills of a person having ordinary skill in the art to which the invention pertains. In the drawings.

FIG. 3 is a side elevation view, partly in section, taken in the direction of arrows III-III in FIG. 2, and showing a tilting log bunk (42) of the rocking carriage (30) tilted approximately parallel to an 11 o'clock to 5 o'clock axis on an imaginary clock face;

FIG. 4 is a side elevation view, partly in section, comparable to FIG. 3, except showing the tilting log bunk (42) shifted to a flatter angle, or approximately parallel to a 9:40 to 3:40 axis on the imaginary clock face;

FIG. 5 is a side elevation view, partly in section, comparable to FIG. 4, except showing the only head assembly (50) in view shifted from an extreme retracted position, as shown in dashed lines, to a relatively more forward position shown in solid lines;

FIG. 6 is a side elevation view, partly in section, comparable to FIG. 5, except showing that the log (36) has had a couple or more of sawn off slices or planks (78) sawn off by a couple or more passes by the bandsaw blade (70) and that the proximal head assembly (50) has shifted back down the slope of the tilting log bunk (42) to the position as shown (ie., in solid lines);

FIG. 7 is a side elevation view, partly in section, comparable to FIG. 6, except showing that the log (36) has been rolled a quarter of a turn counter-clockwise to land on its flat face (ie., the only flat face for the log (36) at this stage), as accomplished by the clockwise travel in an endless circuit by the dog (60) as indicated in FIG. 6 by the dashed-line, clockwise arcuate arrow (62), wherein here in this FIG. 7 the dashed-line arcuate arrow (62) has been reversed to the counter-clockwise direction to signify the dog (60) reversing travel in order to return biting into (or chucking) the top of the log (36);

FIG. 8 is a side elevation view, partly in section, and comparable to all of FIGS. 3 through 7, and showing that the operations shown by FIGS. 5 through 7 are successively repeatable such that the log (36) may be been reduced to a quadrilateral beam, approximately as shown;

DETAILED DESCRIPTION OF THE PREFERRED EMBODIMENTS

Figure 1:
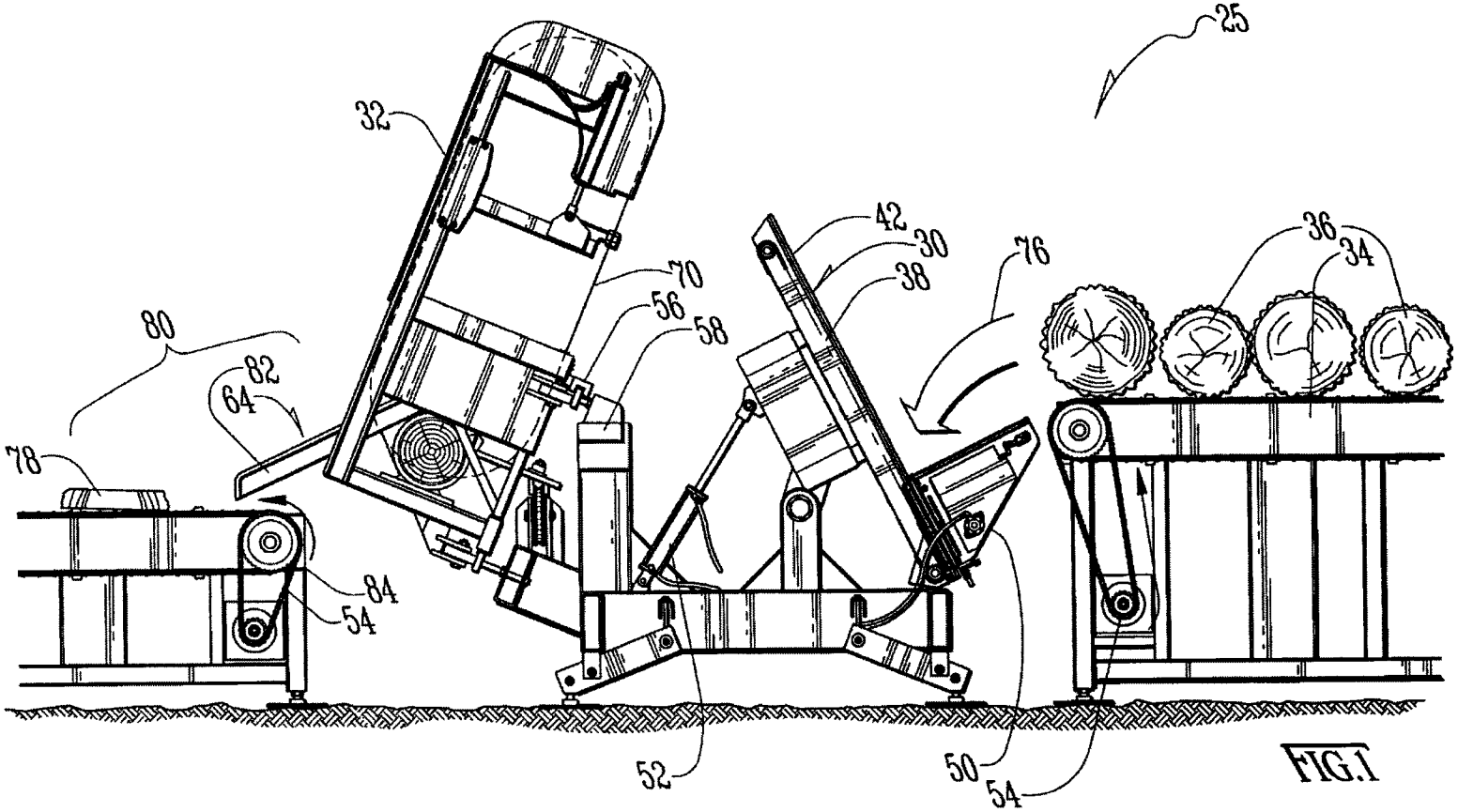
FIG. 1 is a left-side, side elevation view of a first embodiment of a sawmill (25) in accordance with the invention provided with a rocking carriage (30) in accordance with the invention as well as an outflow conveyor system (80) in accordance with the invention.
Figure 2:
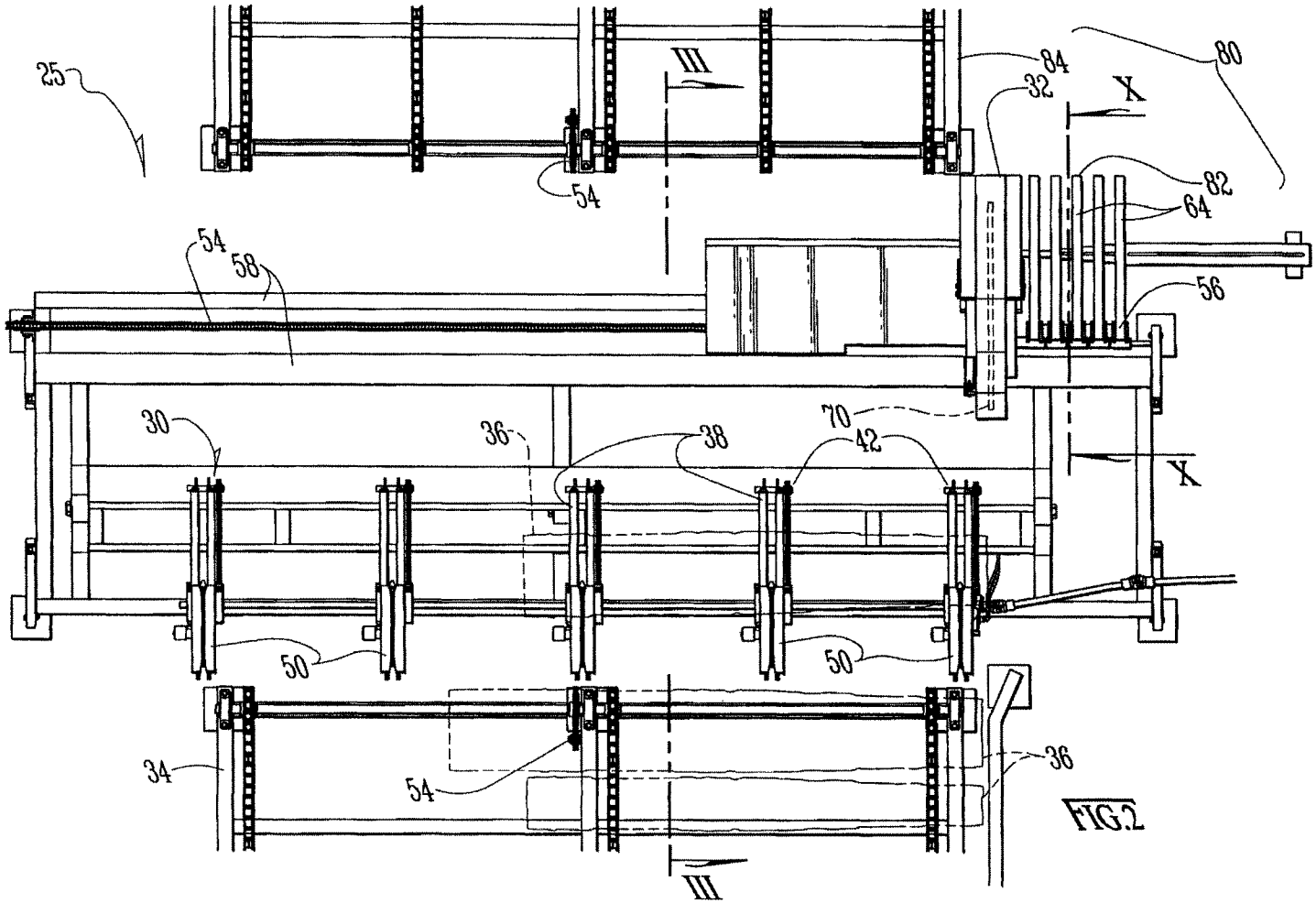
FIG. 2 is a top plan view thereof, with the bandsaw (32) that traverses cyclically in strokes back and forth from left-to-right (given the orientation of the view) shown in the extreme right position (which comprises a relative "home" position)

FIGS. 1 and 2 show a sawmill 25 in accordance with the invention.

The sawmill 25 comprises:

a rocking carriage 30;

a bandsaw 32;

an infeed log deck 34; and an outflow conveyor system 80.

Infeed log deck 34 is loaded with a supply of logs 36 to feed to the rocking carriage 30. The infeed log deck 34 is shown for example and without limitation as comprising a chain-driven, chain conveyor belt.

The rocking carriage 30 comprises:

a series of spaced pairs of parallel frame members 38;

the frame members 38 cooperatively forming a tilting log bunk 42;

a series of head assemblies 50, each associated with one pair of frames 38;

various hydraulic cylinder systems 52;

various chain (and sprocket) drive systems 54;

perhaps other drive systems such as rack-and-pinion 56; and as shown better in FIG. 2, various cross members 58; and so on and among other things.

Each head assembly 50 has:

a dog 60.

Figure 4:
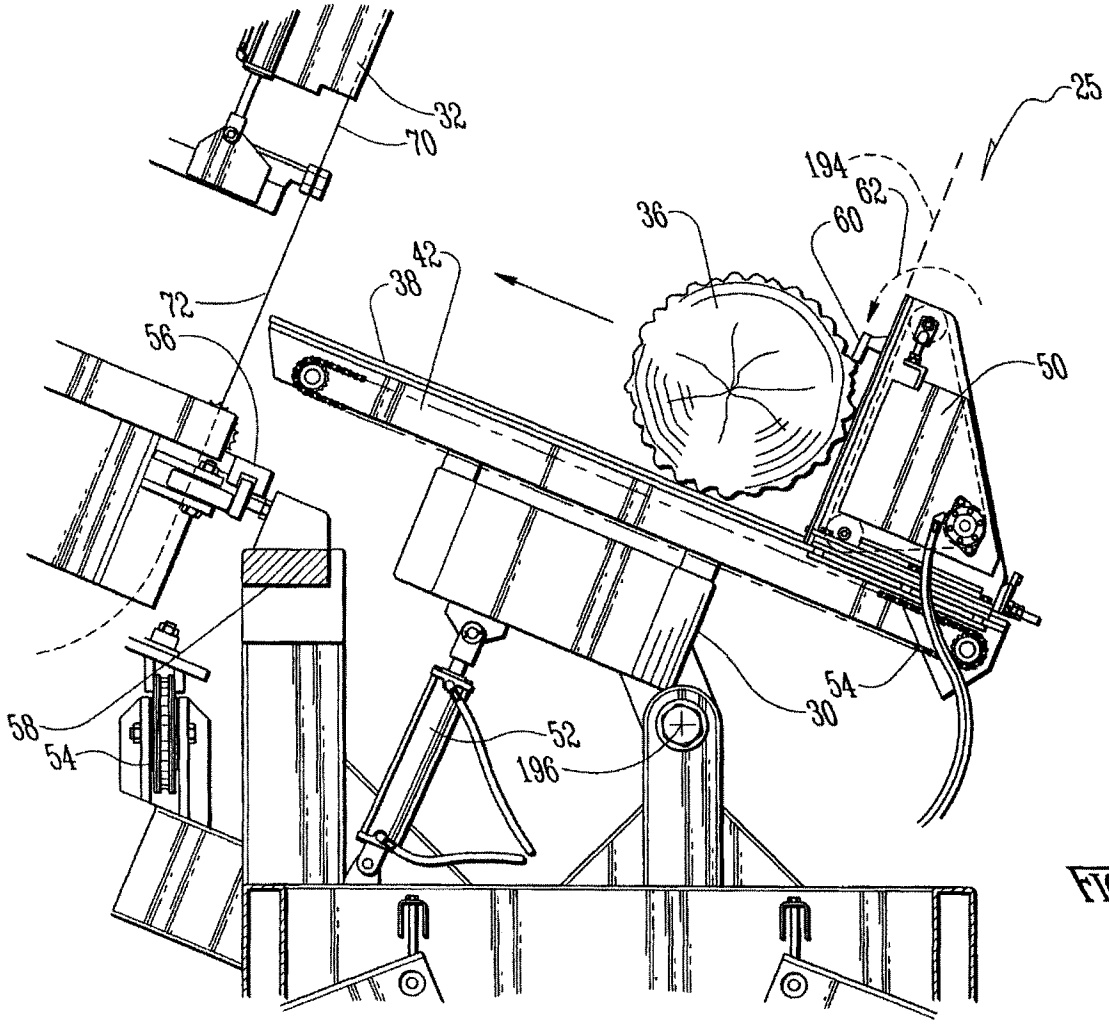
Figure 6:
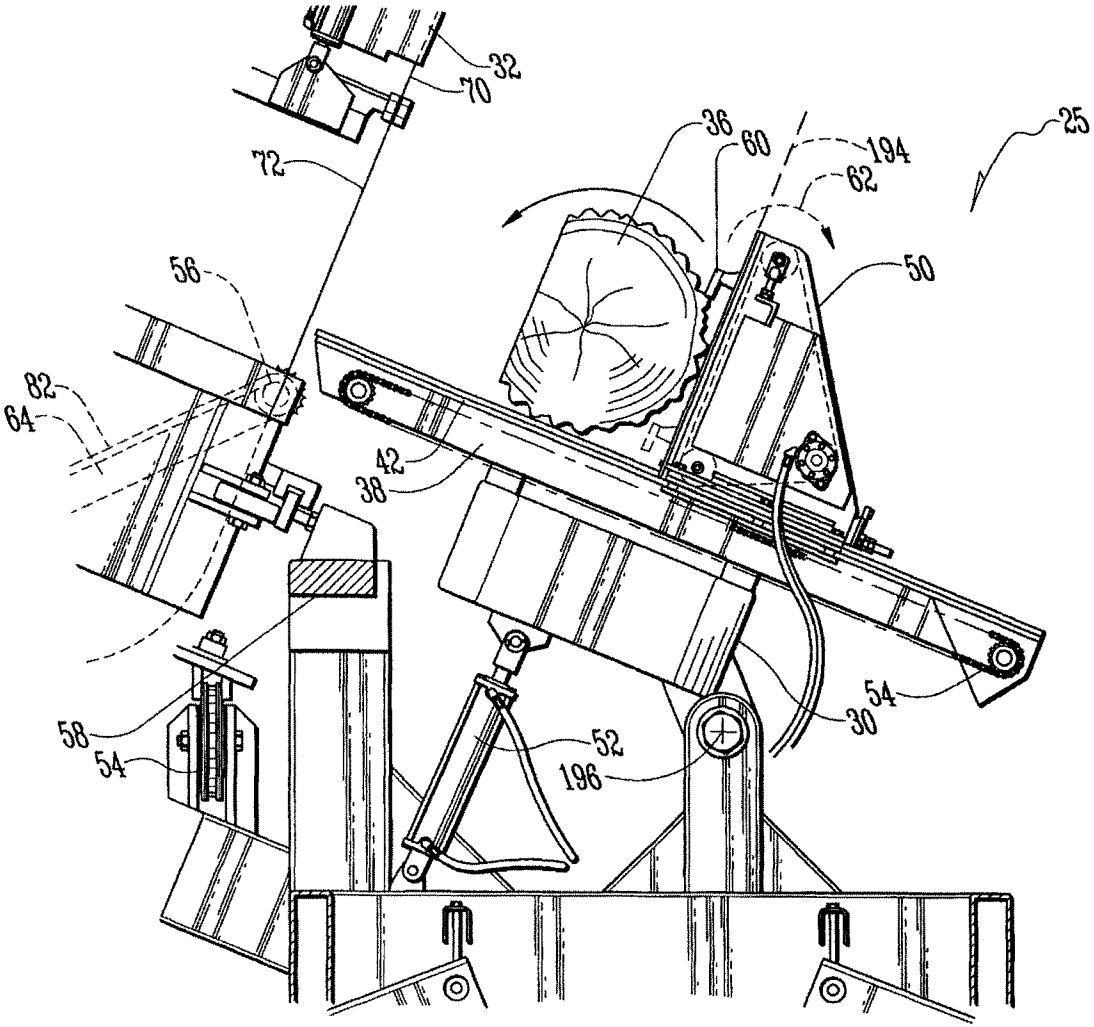

The dog 60 can be likened to a hay hook or a tooth. FIG. 4 shows the dog 60 being driven counter-clockwise (CCW) as indicated by broken-line arrow 62. In contrast, FIG. 6 shows the arrow 62 for indication the travel direction of the dog 60 being clockwise (CW). The dog 60 can driven in a full 360° orbit about the periphery of the head assembly 50 in a square-D shaped orbit.

FIG. 1 shows a series of logs 36 piled on the infeed log deck 34 for feeding to the rocking carriage 30. The log bunk 42 is empty. The bandsaw 32 is mounted on a traveling carriage and can be driven reversibly into and out of the view of FIG. 1 (ie., reversibly left and right in FIG. 2). FIG. 2 shows the bandsaw 32 in the extreme right position (eg., 'right' given the orientation of the view), which can be assigned to be a relative 'home' position for the bandsaw 32 when the log bunk 42 is tilted up as shown. The 'home' position is the start position for the bandsaw 32 if the saw blade 70 only has teeth on the left edge thereof (eg., 'left' given the orientation of the view).

FIG. 1 shows the beginning of time for loading a log 36 onto the log bunk 42. FIG. 2 shows the end-result of loading a log 36 onto the log bunk 42 (albeit the log 36 in FIG. 2 is shown in dashed lines).

Figure 3:
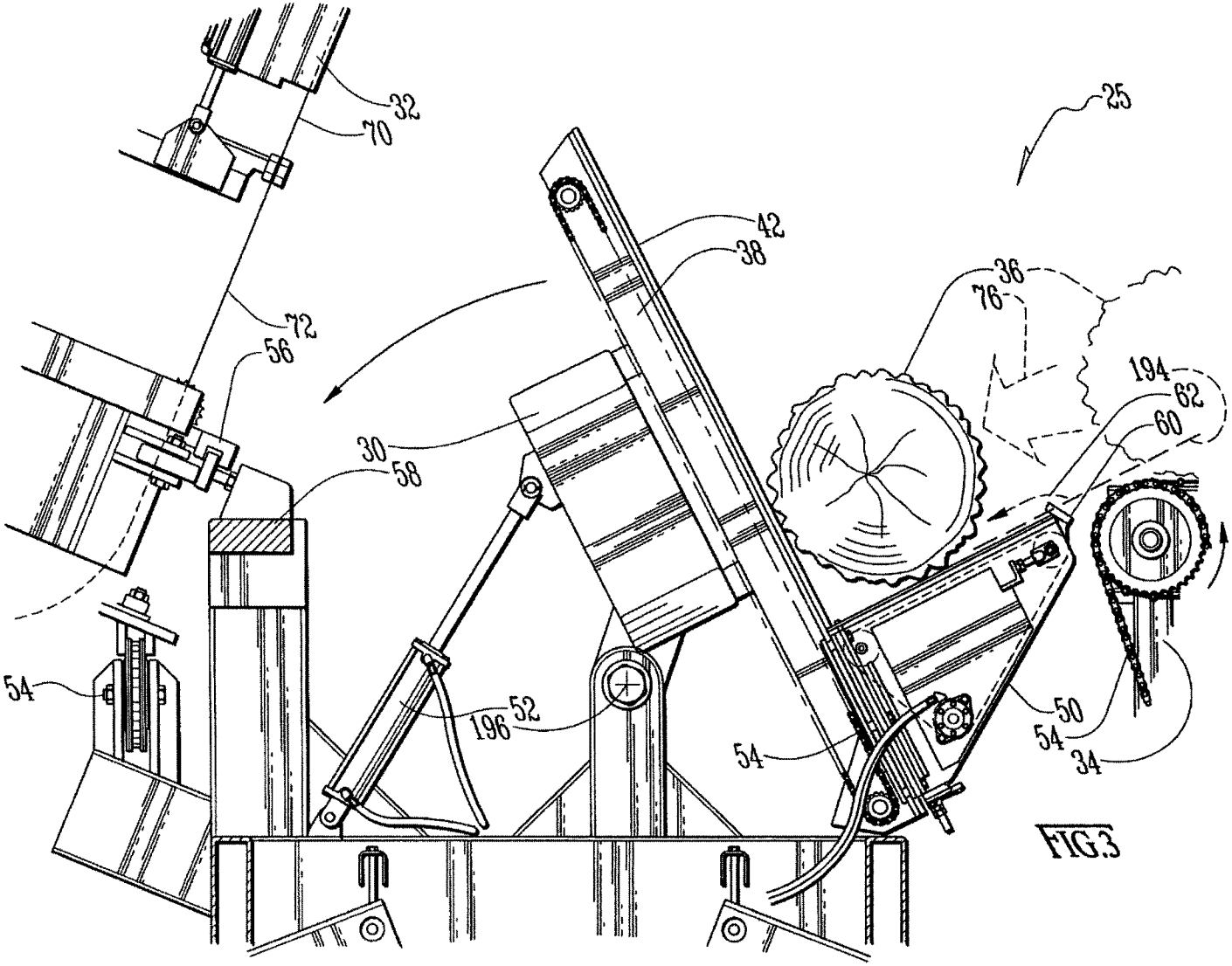
FIGS. 3-8 are a series of left-side, side elevation views, partly in section, showing a series of movements by the rocking carriage (30) for loading a fresh new log (36) into a chucked-position as chucked by a plurality of spaced head assemblies (50), and also show the results of one or more passes of the bandsaw (32) to form sawed-off slices or planks (78), wherein:—

FIGS. 3-8 comprise a slide show that illustrates the progression of loading a log 36 onto the log bunk 42 and producing sawn-off slices or planks 78, wherein FIG. 2 corresponds to a time corresponding to FIG. 3.

In FIG. 3, the bandsaw 32 is mounted on a traveling carriage and can be driven reversibly into and out of the view of FIG. 1 such that the saw blade 70 will travel reversibly into and out of the view in a plane indicated by the line given the reference numeral 72 (ie., same line for saw blade 70). In FIG. 2, the head assemblies 50 are aligning the tapered log 36 such that the outboard presentation of the log 36 to the plane 72 of the travel of the saw blade 70 is oriented in a parallel plane 74 (to the extent possible, given that tree trunk shapes can be highly irregular, especially so for hardwoods more than for, eg., pine).

FIG. 3 shows that the infeed log deck 34 has served the lead log 36 of the row of logs 36 loaded upon the infeed log deck 34 onto the rocking carriage 30 or, more particularly, into the bottom of the up-tilted corner formed by the log bunk 42 and head assemblies 50.

FIG. 4 shows that the rocking carriage 30 including the log bunk 42 and head assemblies 50 thereof have pivoted CCW such that the log bunk 42, albeit at an incline, is perpendicular to the saw blade 70, which is also titled. The dog 60 has been driven CCW into the outer skin (eg., bark) of the log 36 to get a 'bite' or a 'clamp' thereon.

Figure 5:
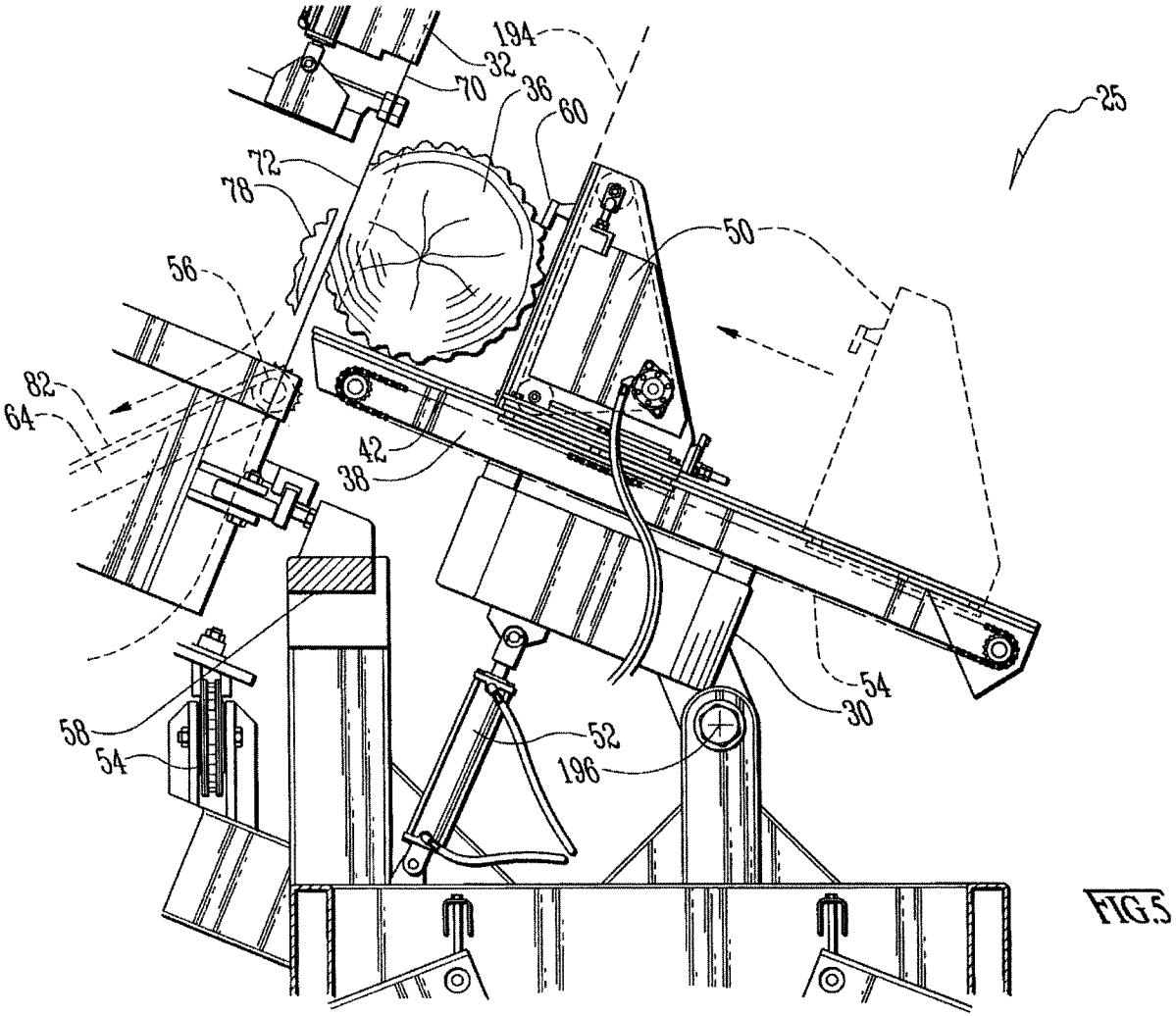

FIG. 5 shows the head assemblies 50 presenting the log 36 for a first pass through by the saw blade 70, and perhaps a second pass. In FIG. 5, the head assemblies 50 would be indexed in incremental steps for the purpose of sawing a succession of passes, as for sawing planks. The slices 78 of each log 36 containing a lot of the outer skin (eg., bark) is likely discarded as waste or, at best, sent to a chipper or the like. Deeper cuts into the heart of the log 36 are better likely to produce planks 78 or beams and the like worthwhile for keeping for perhaps plaining and drying as well as other secondary treatments.

Preferably the saw blade 70 has teeth on both sides so that the saw blade 70 can have both an outbound path away from the home position and a reverse inbound path back to the home position. That way, the traveling carriage carrying the bandsaw 32 does not have to make a wasteful return pass where it is not sawing the log 36. That is shown better in connection with FIGS. 21 and 22.

FIG. 6 shows the dog 60 in the process of being driven in a full CW orbit, as indicated by arrow 62, to come up underneath the log 36 and roll it a quarter of a roll CCW to land the log 36 on its flat surface.

Figure 7:
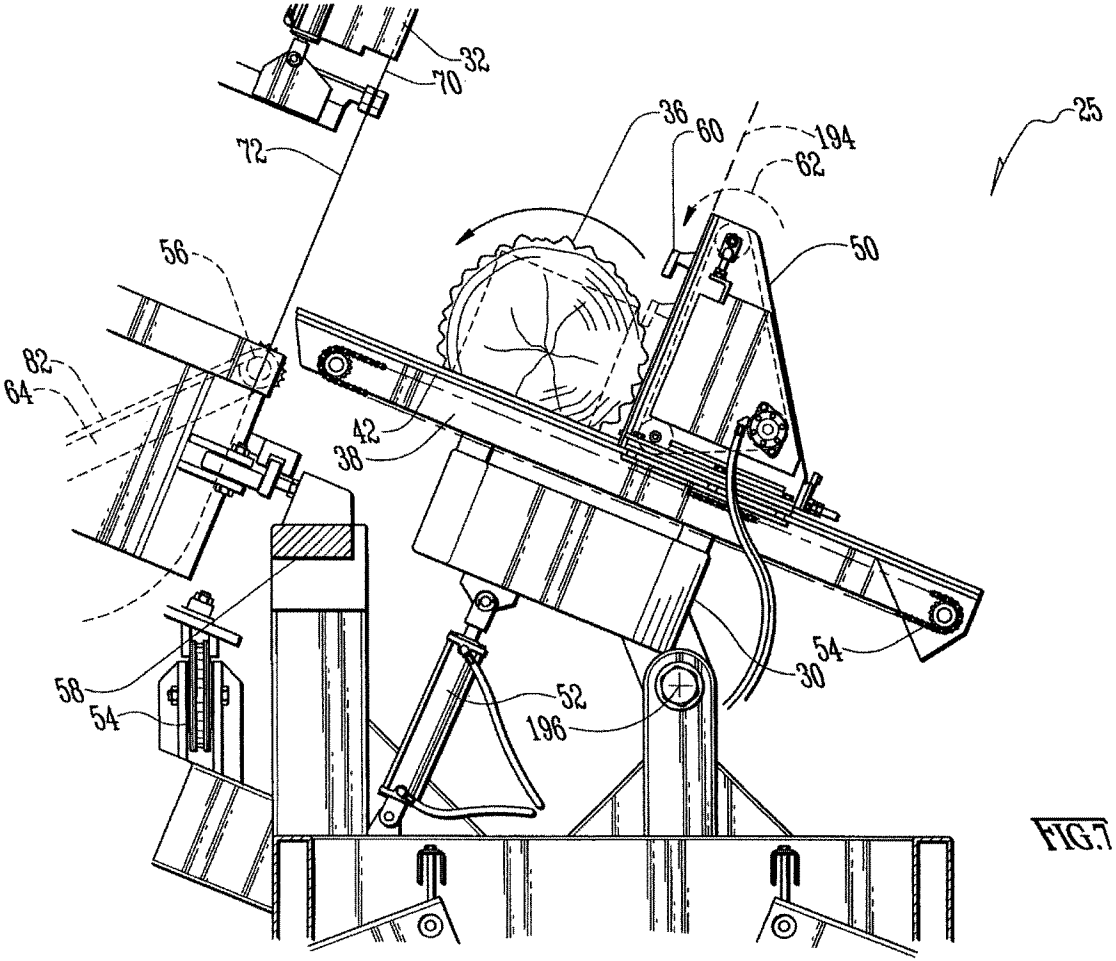

FIG. 7 shows that indeed the log 36 has landed on its flat face (ie., its only flat face so far at this stage). The dog 60 will be reversed (eg., driven CCW in this view, as indicated by arrow 62) and thus driven to get a fresh 'bite' or 'clamp' on the log 36.

Figure 8:
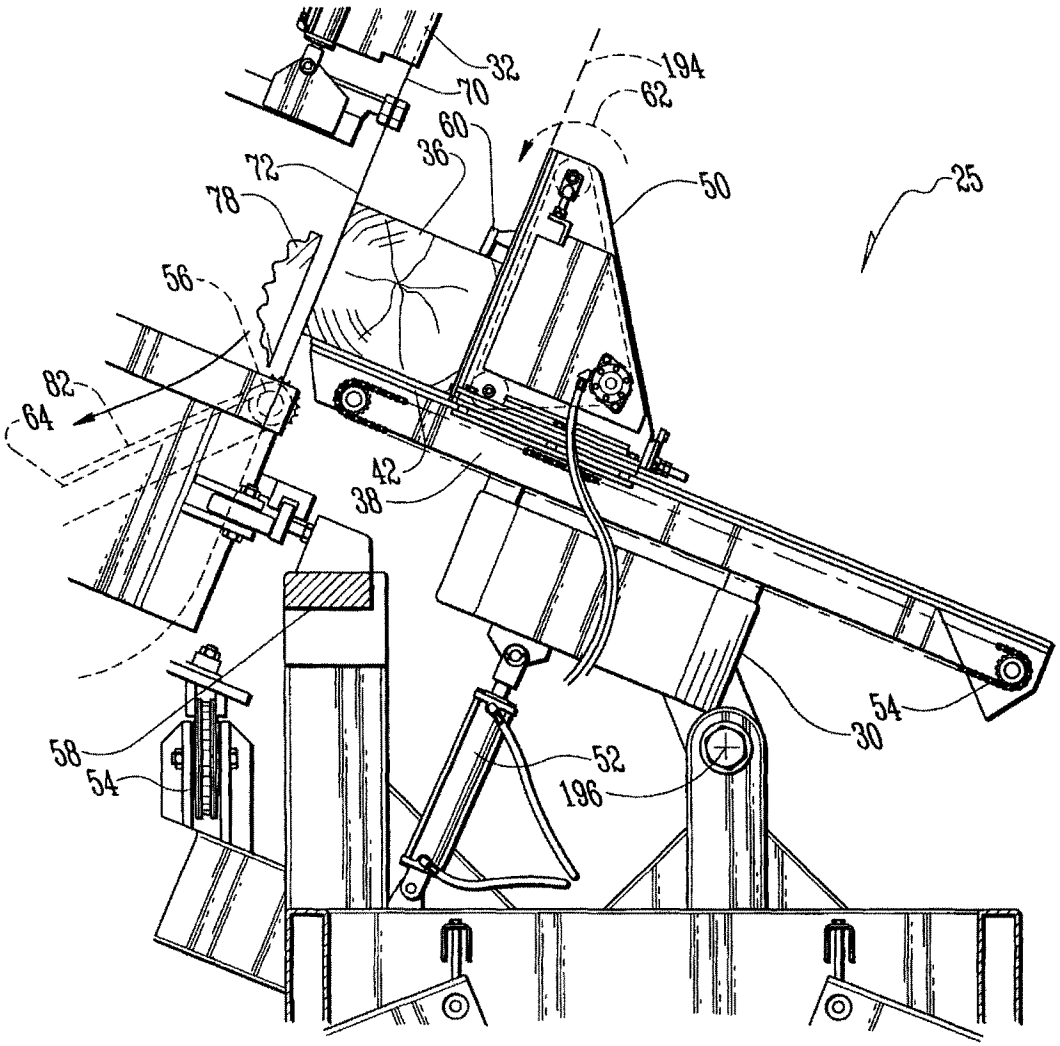

FIG. 8 shows that this manipulation between the dog 60 and head assembly 50 can continue, and roll the log 36 several times, until about the largest-size quadrilateral beam that can be produced from the log 36 is obtained. If wanted, user's can slice this beam away to planks 78 or do otherwise.

Figure 9:
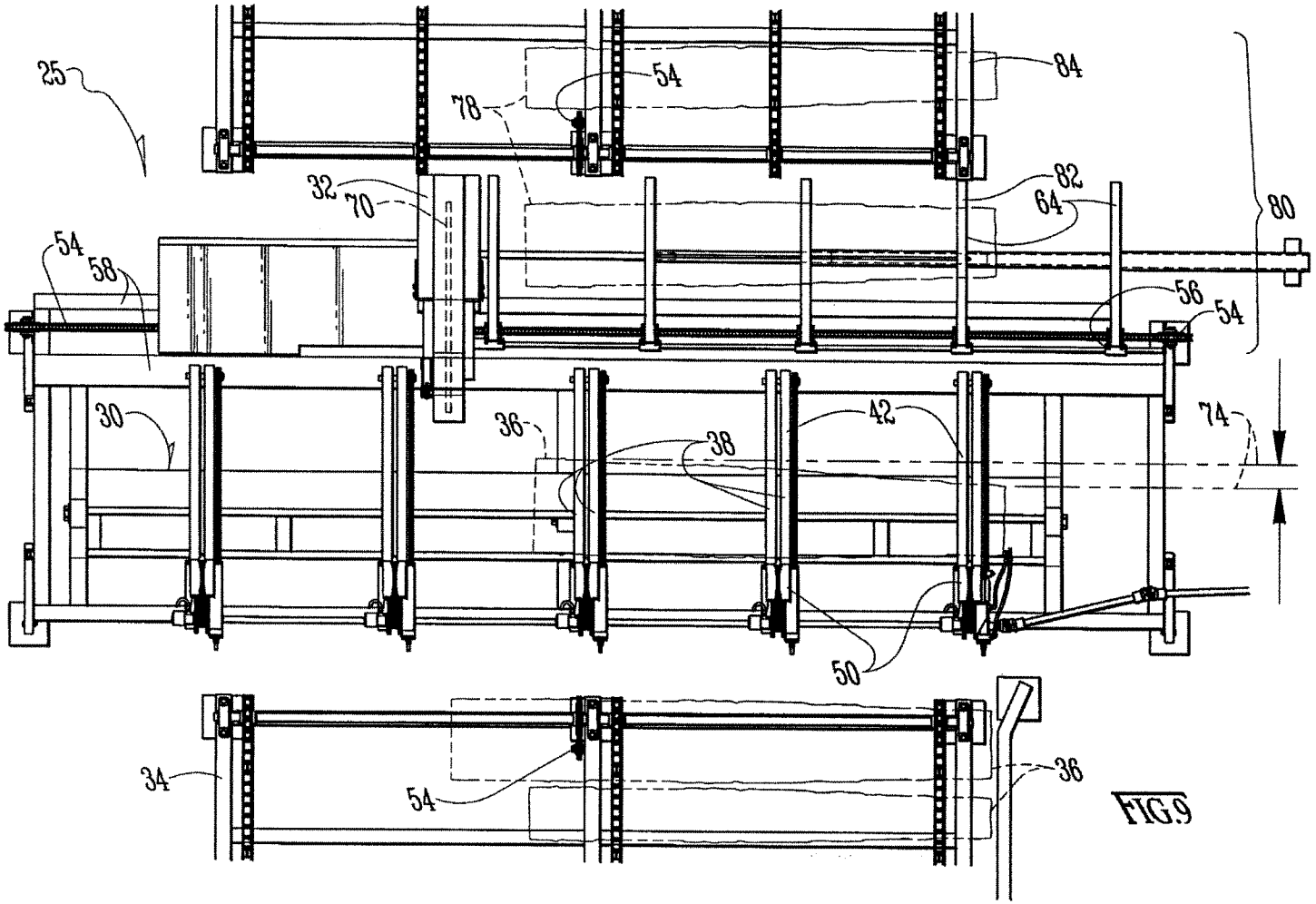
FIG. 9 is a top plan view comparable to FIG. 2 except showing the bandsaw (32) in a further left position, and having passed through the chucked log (36), wherein this FIG. 9 further shows the operation of the outflow conveyor system (80) for conveying away sawn off planks (78)

FIG. 9 shows operation of the outflow conveyor system 80 in accordance with the invention for automatically conveying away sawn off planks 78 (or waste strips or slices 78, and perhaps even valuable beams, etc.).

More particularly, the outflow conveyor system 80 comprises:

a series of parallel ribs 64 forming a downslide 82;
an outflow log deck 84;
various chain (and sprocket) drive systems 54; and
perhaps other drive systems such as rack-and-pinion.

The outflow log deck 84 is shown for example and without limitation as comprising a chain-driven, chain conveyor belt.

Comparing FIG. 2 to FIG. 9 shows that the series of parallel slender ribs 64 forming the downslide 82 are not static but dynamic. The ribs 64 can be telescoped between expanded apart (open) and foreshortened (shut) extremes. This can be likened to the ribs 64 (that form the downslide 82) being moved apart from one another to form the expanded extreme (as shown in FIG. 9), in the style of any of the following, eg.:— a festooned cable system,
a buffers and chain coupler system a la 19$^{th}$ Century European railroad cars,
a transverse-rod style of curtains/drapes,
a series of telescoped sleeves or drawer slides,
lazy tongs, and so on.

Figure 19:
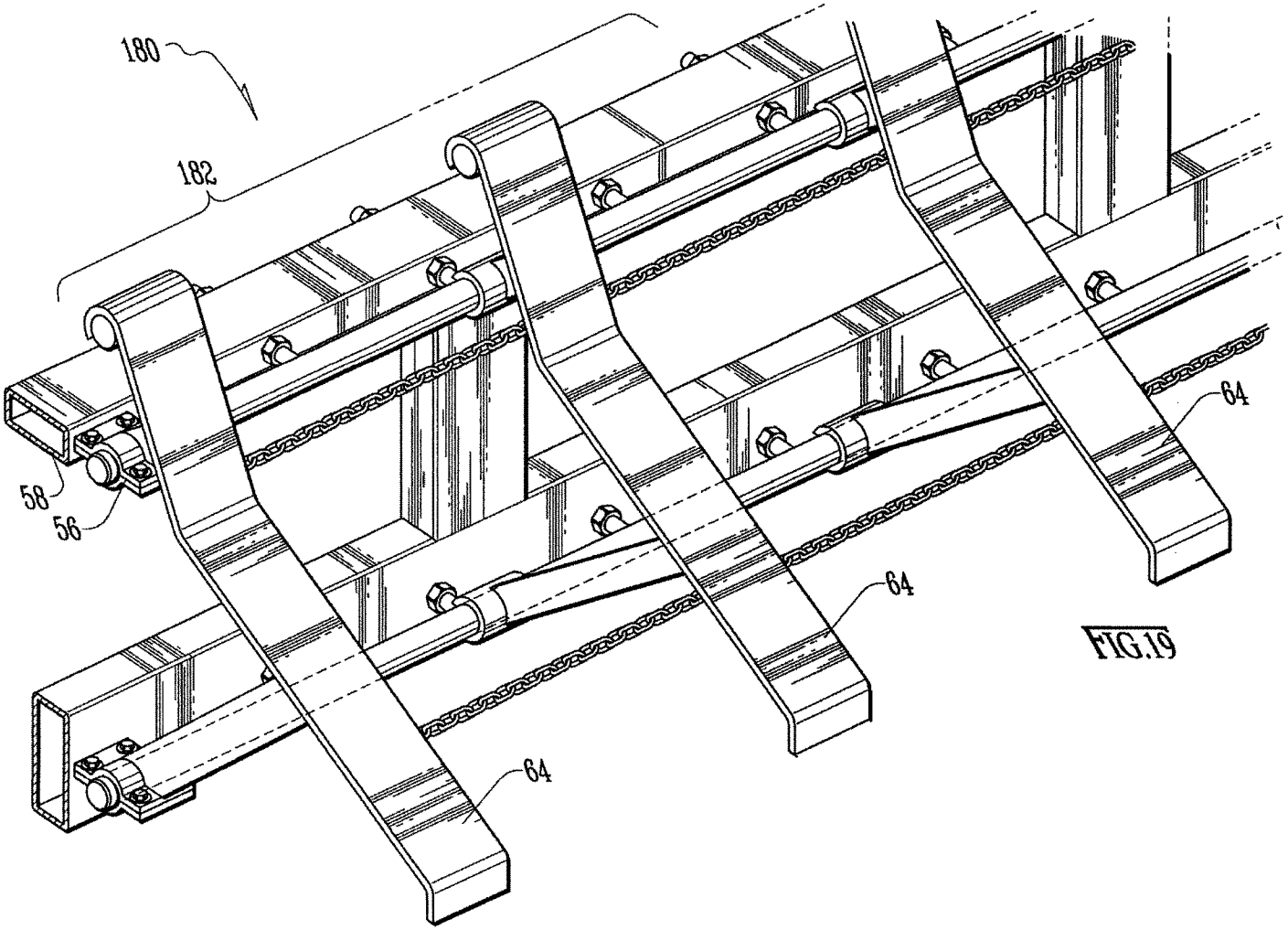
FIG. 19 is a rear perspective view taken in the direction of arrows XIX-XIX in FIG. 18, wherein the plurality of spaced apart slender ribs (64) that make up the downslide (82) are shown in the fully expanded (open) state.

The ribs 64 can be wholly passive and arranged to be dragged apart and pushed back together by the out and back traversing of the bandsaw 32. Alternatively, the ribs 64 can be driven by means other than the pull and push of the bandsaw 32, and within synchronization with the traversing of the bandsaw 32. FIG. 19 shows the ribs 164 being arranged to be moved by the tug and the ramming of the bandsaw 32 as it goes back and forth, with no further drive assistance. However, if the ribs 64/164 were coupled by telescoping sleeves or lazing tongs and the like, the ribs could be driven independent of the pull or push of the bandsaw 32, and controlled independently as well.

FIG. 19 shows that the ribs 164 are tugged apart by a festooning chain, and would be collapsed back together by the compression from the returning bandsaw 32.

FIGS. 17 through 22 show better the expansion (to open) strokes and foreshortening (to shut) strokes of the ribs 164.

FIG. 2 shows the shut extreme for the parallel ribs 64 that form the downslide 82. All the ribs 64 are closely spaced together. FIG. 9 shows a relatively open extreme. All the ribs 64 are relatively spaced apart.

The rightmost rib 64 ("right" given the orientation of FIGS. 2 and 9) is fixed. All the other ribs 64 are movable. In FIG. 2, the ribs 64 are all telescoped to a relatively foreshortened (and shut) state. In FIG. 9, the ribs 64 are telescoped apart to a relatively open state. It is an aspect of the invention that the ribs 64 present no impediment to the travel of the bandsaw 32 and/or saw blade 70. To the contrary, the arms 64 always remain in a clear of the bandsaw 32, regardless if the bandsaw 32 is traveling left or in right.

Figure 10:
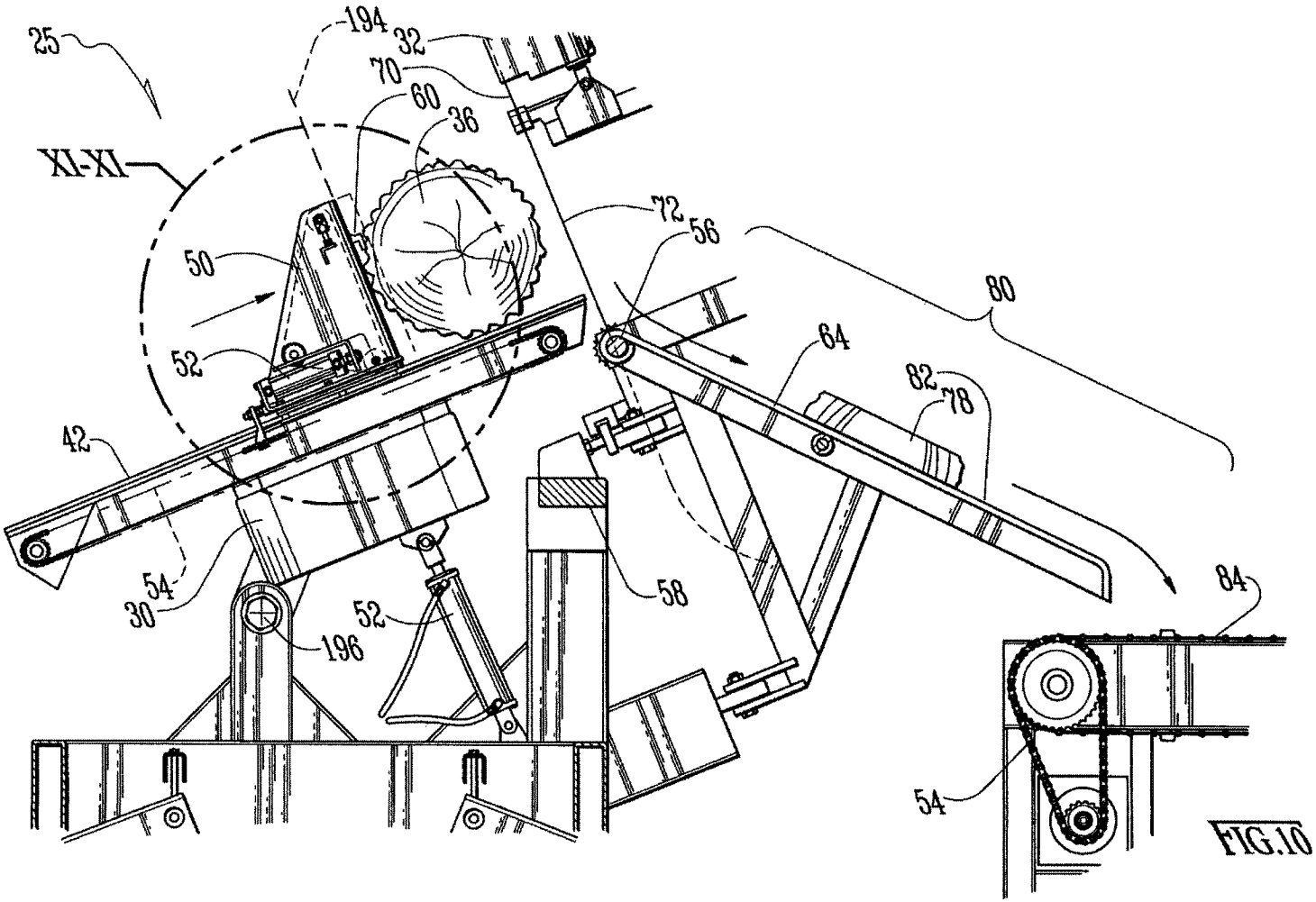
FIG. 10 a side elevation view comparable to FIG. 4 except taken from a right-side vantage point, and not a left-side vantage point.

However, in FIGS. 2 and 9, the ribs 64 always provide the trailing space behind the bandsaw 32—as it travels forward—collectively with a downslide 82. FIG. 10 shows one plank 78 or waste slice sliding down the downslide 82 to transfer onto and be conveyed away from there by outflow log deck 84.

Figure 11:
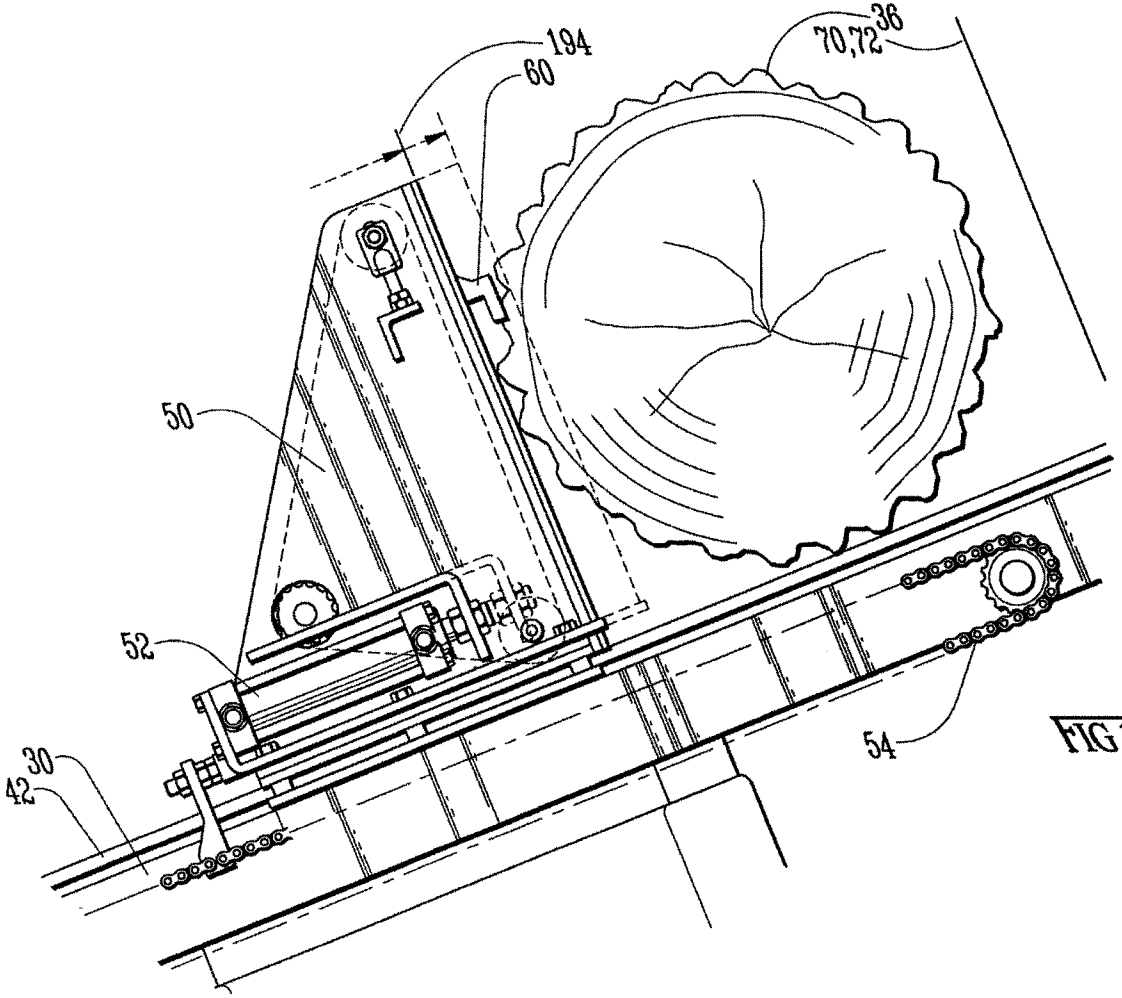
FIG. 11 is an enlarged-scale elevation view of detail XI-XI in FIG. 10.
Figure 13:
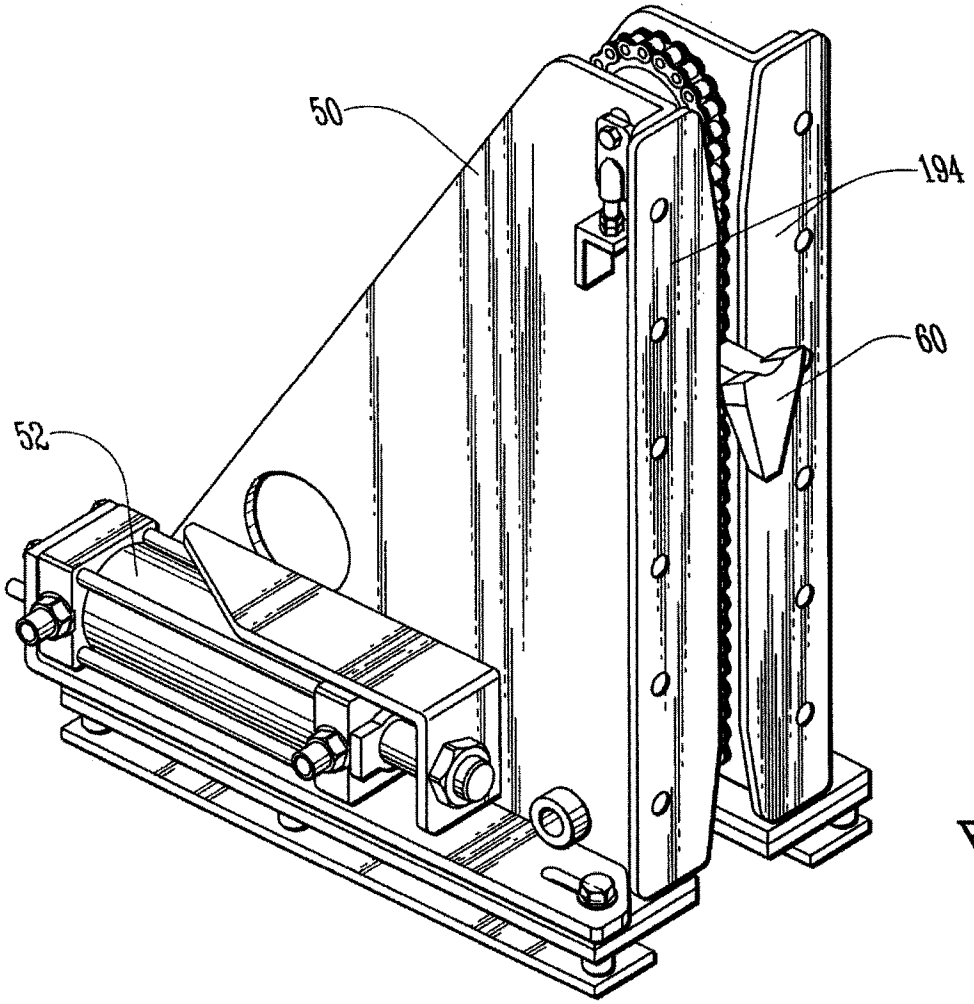
FIG. 13 is an enlarged scale perspective view of a single one of the plurality of head assemblies (50) in accordance with the invention, as representative of the others.

FIGS. 11 and 13 show a hydraulic actuator 52 that advances one head assembly 50 ahead of a line of other head assemblies 50 (see FIG. 2) to true up the outboard presentation of the log 36 to plane 74.

Figure 12:
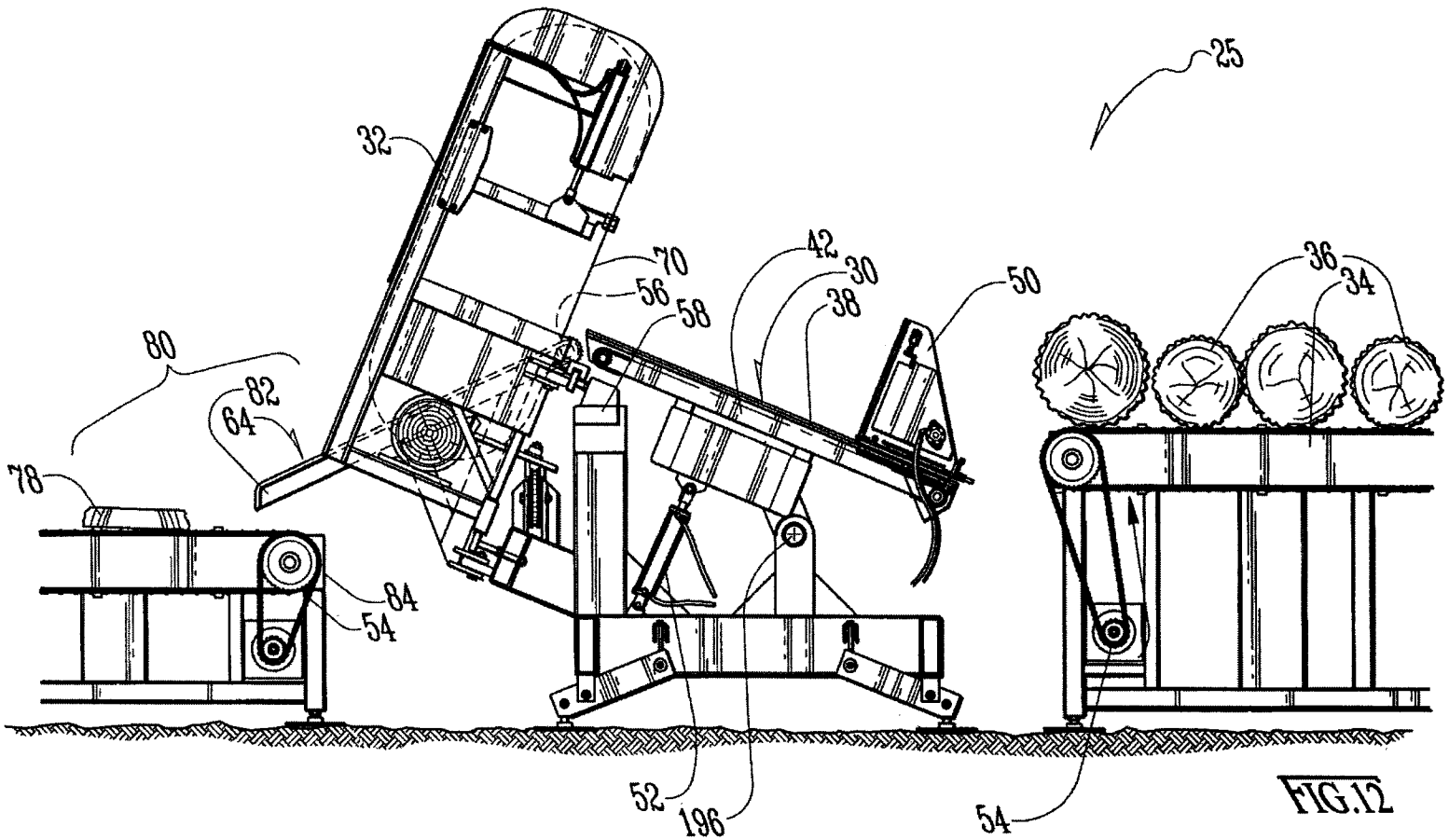
FIG. 12 is a side elevation view comparable to FIG. 1 except showing the rocking carriage (30) at a time before it tips back to pick up another log (36)

FIG. 12 is a side elevation view comparable to FIG. 1 except showing the rocking carriage 30 empty of a log 36, and ready to rock back as shown in FIG. 1 and pick up another log 36 from the infeed log deck 34.

Figure 14:
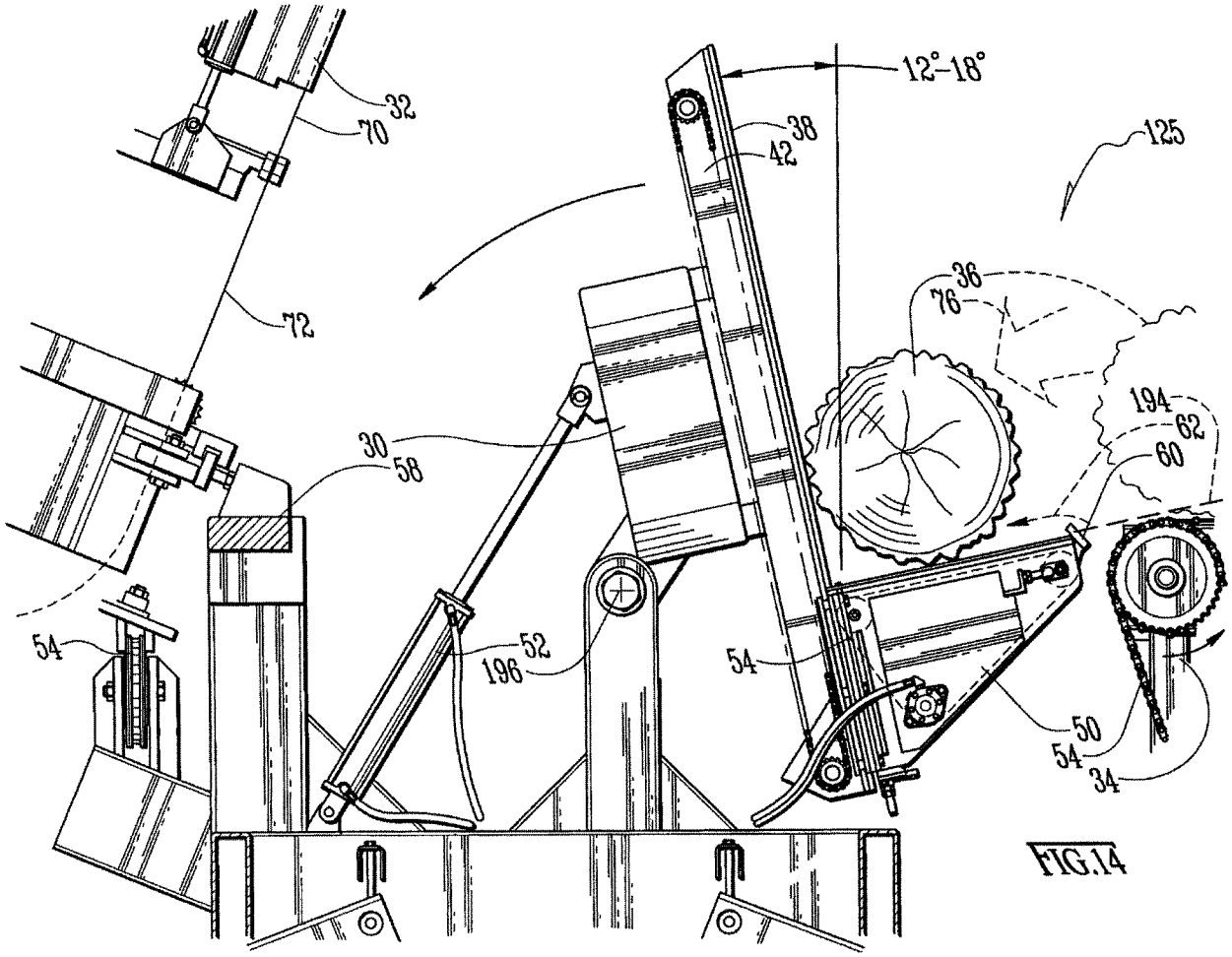
FIG. 14 is a left-side, side elevation view, partly in section and comparable to FIG. 3, except of a second embodiment of a sawmill (125) in accordance with the invention equipped with the rocking carriage (30) as well as a second embodiment of an outflow conveyor system (180) in accordance with the invention, and showing that the tilting log bunk (42) of the rocking carriage (30) is in this view tilted to approximately between 12° and 18° shy of vertical.

FIG. 14 is a left-side elevation view comparable to FIG. 3 except showing a second embodiment of a sawmill 125 in accordance with the invention equipped with the rocking carriage 30 as well as a second embodiment of an outflow conveyor system 180 in accordance with the invention. The tilting log bunk 42 of the rocking carriage 30 is shown in this FIG. 14 tilted to approximately between 12° and 18° shy of vertical.

Figure 15:
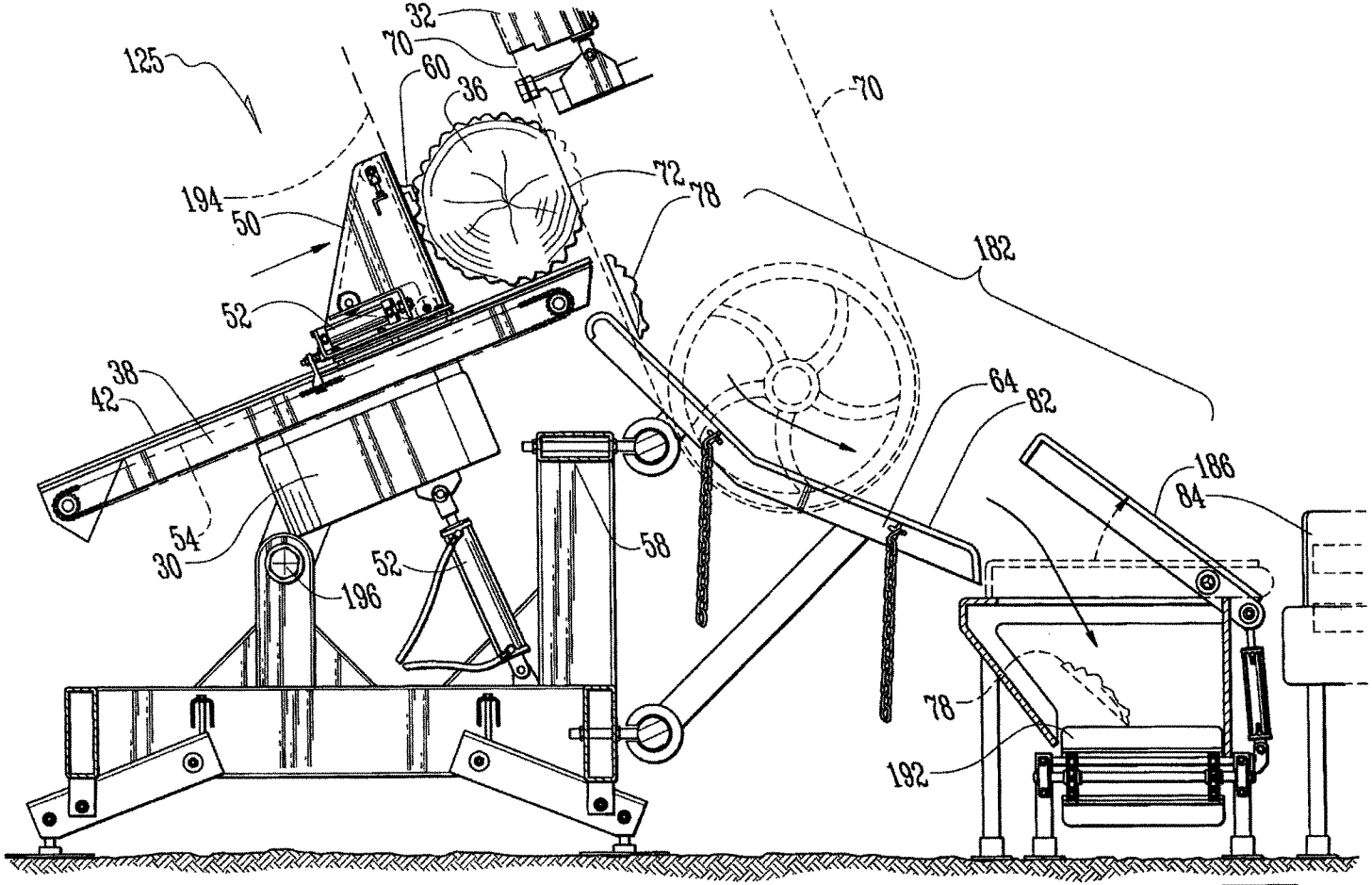
FIG. 15 right-side, side elevation view, comparable to FIG. 10 except of the second embodiment of the sawmill (125) in accordance with the invention and the second embodiment of the outflow conveyor system (180) in accordance with the invention, wherein the lid (186) of a channel (188) that houses a waste conveyor (192) is tipped up to catch a waste slice of lumber (78), probably due to high bark content or the like, presumably to be conveyed away to a chipper or the like (not shown), and showing the tilting log bunk (42) of the rocking carriage (30) tilted to preferably 22.5° from horizontal.

FIG. 15 right-side elevation view comparable to FIG. 10 except of the second embodiment of the sawmill 125 in accordance with the invention and the second embodiment of the outflow conveyor system 180 in accordance with the invention. In this view, the lid 186 of a channel 188 that houses a waste conveyor 192 is tipped up to catch a waste slice of lumber 78. The waste slice of lumber 78 is likely regarded to be waste or low worth probably due to high bark content or the like. The waste slice of lumber 78 will presumably be conveyed away to a chipper or the like (not shown). In this FIG. 15, the tilting log bunk 42 of the rocking carriage 30 is shown tilted to preferably 22.5° from horizontal.

Figure 16:
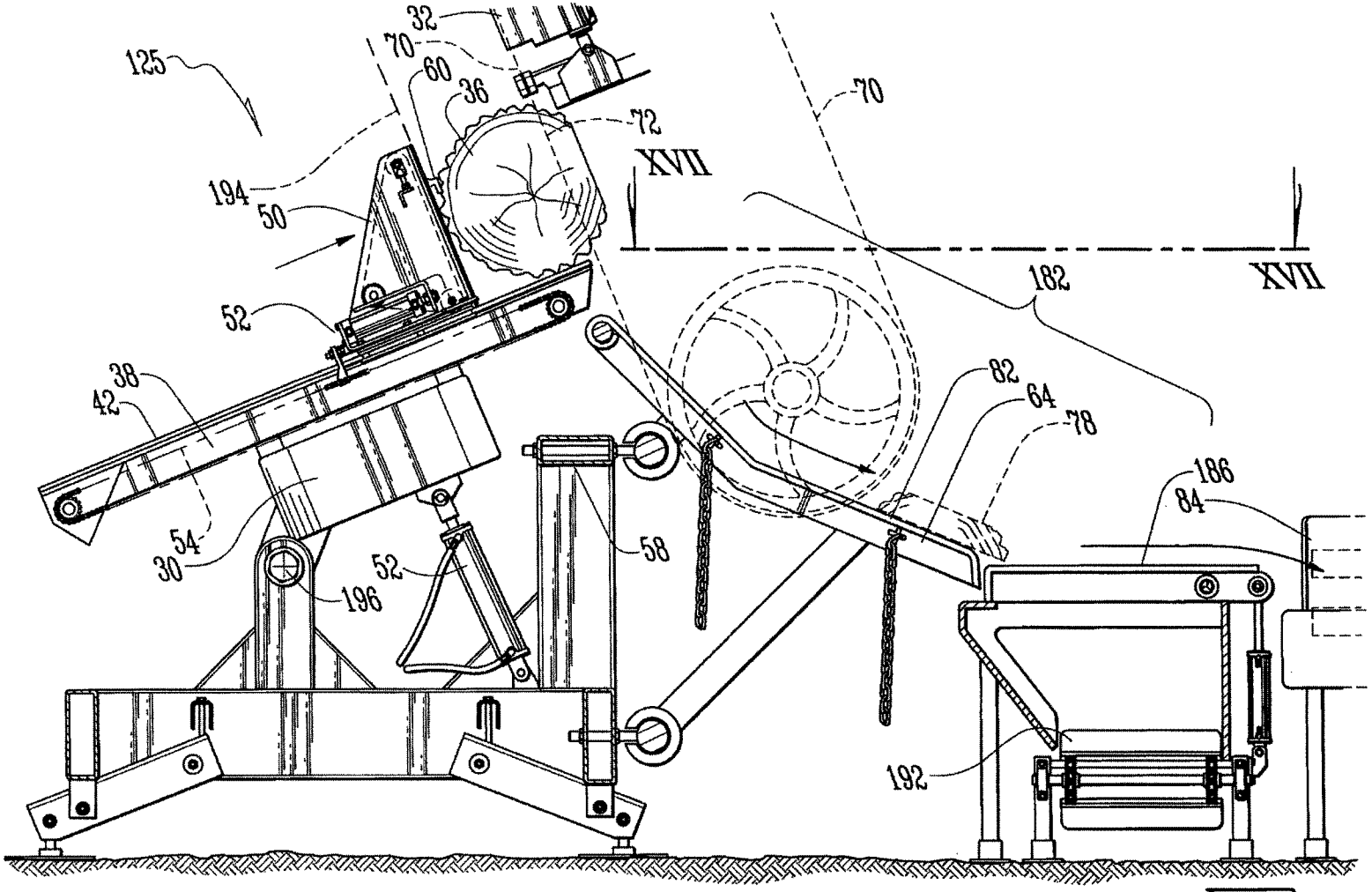
FIG. 16 is right-side, side elevation view, comparable to FIG. 15 except showing a sawn-off plank (78), worthwhile for keeping, about to slide down the downslide (82) and then across the closed lid (186) of the channel (188) housing of the waste conveyor (192) to land on the production line conveyor (84), presumably to be conveyed away to a plainer or the like (not shown), wherein the downslide (82) has an upper steep portion preferably inclined at 45° from horizontal and a lower shallower portion preferably inclined at 22.5° from horizontal.

FIG. 16 is right-side elevation view comparable to FIG. 15 except showing a different sawn-off plank 78, worthwhile for keeping about to slide down the downslide 82 and then across the closed lid 186 of the channel 188 housing of the waste conveyor 192 to land on a regular, production line conveyor 84, presumably to be conveyed away to a plainer or the like (not shown). The downslide 82 has an upper steep portion preferably inclined at 45° from horizontal and a lower shallower portion preferably inclined at 22.5° from horizontal.

Figure 17:
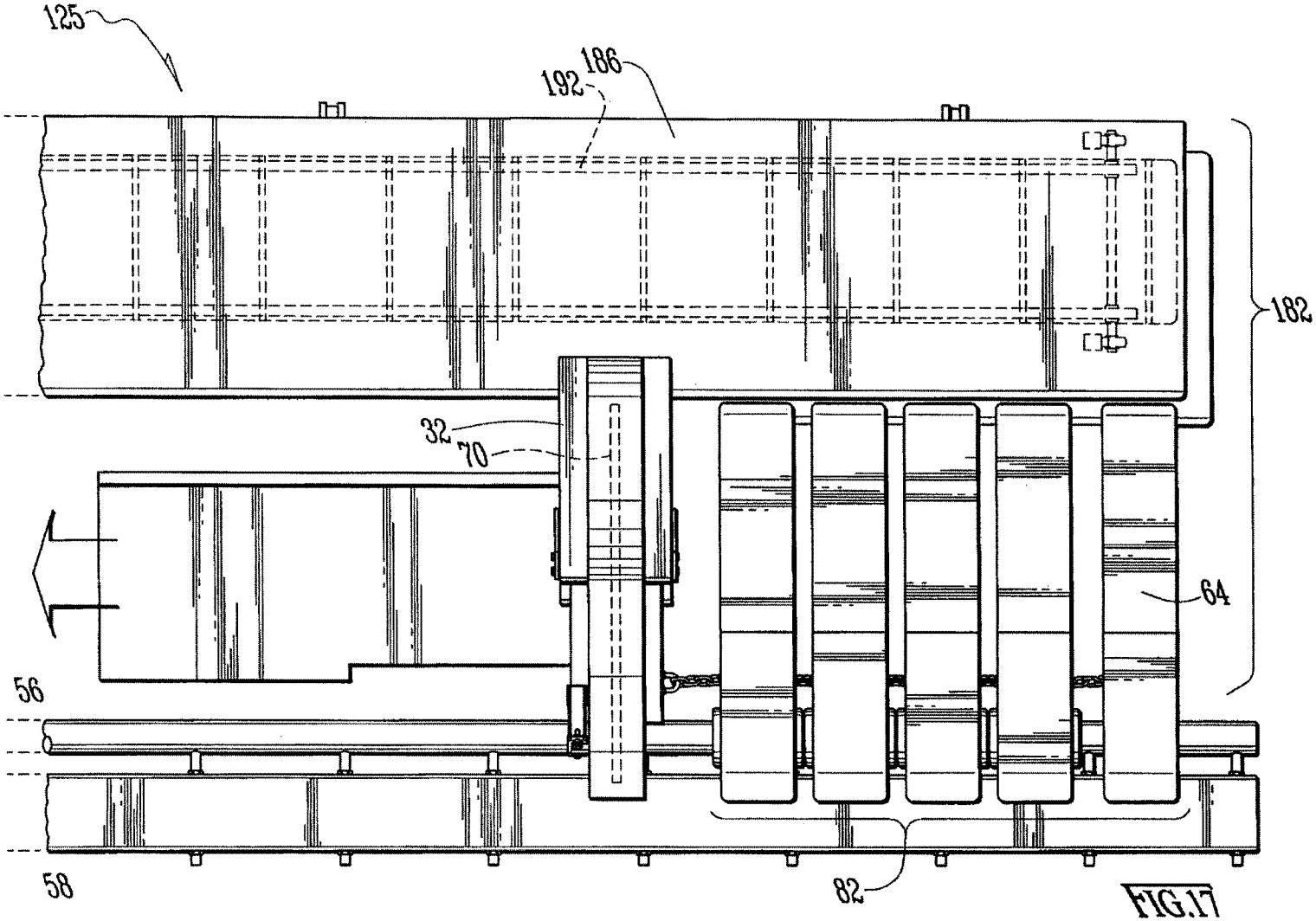
FIG. 17 is a top plan view taken in the direction of arrows XVII-XVII in FIG. 16 and showing that the downslide (82) comprise a plurality of spaced apart slender ribs (64)

FIG. 17 is a top plan view taken in the direction of arrows XVII-XVII in FIG. 16 and showing that the downslide 82 comprise a plurality of spaced apart slender ribs 64.

Figure 18:
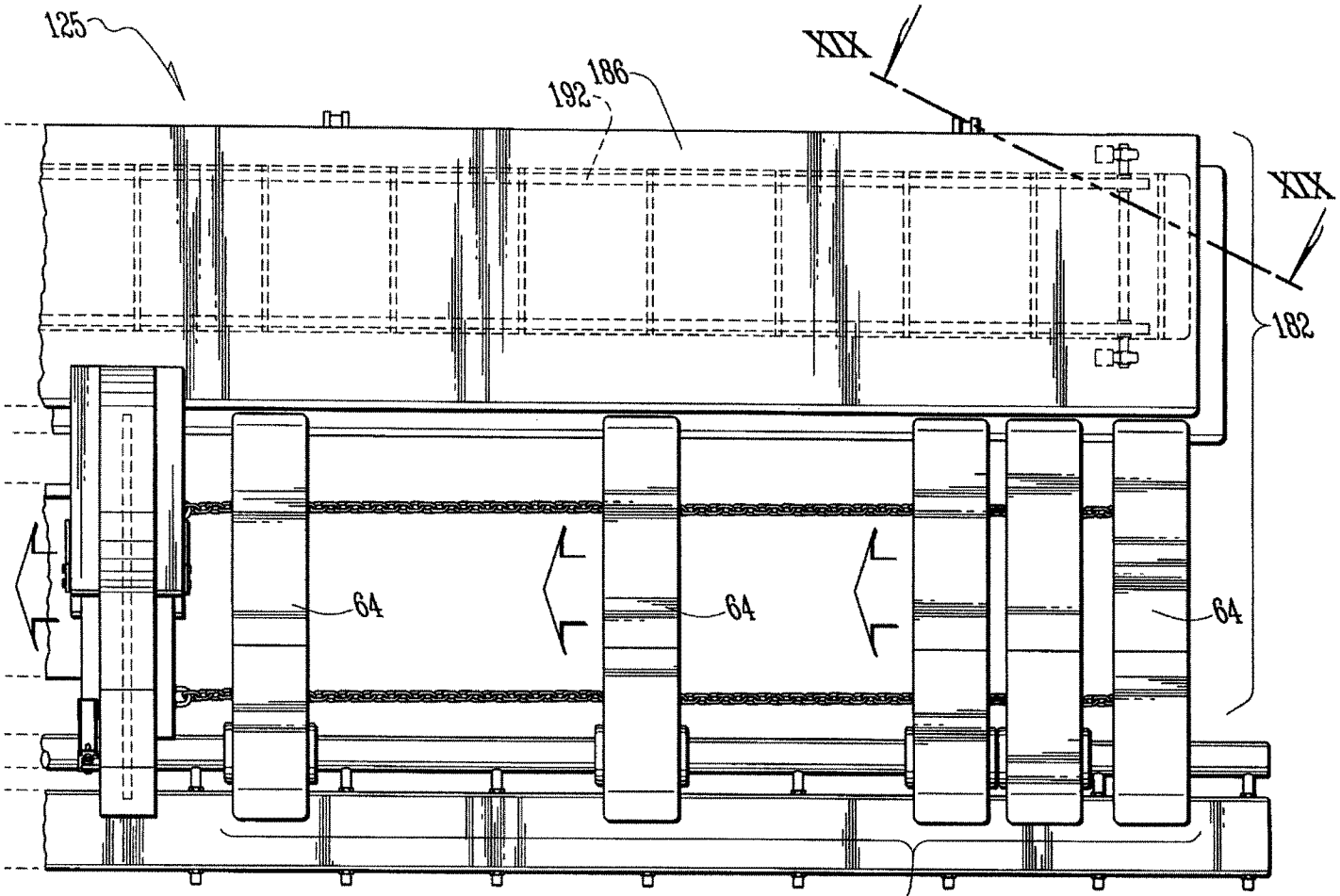
FIG. 18 is a top plan view comparable to FIG. 17 except showing that the plurality of spaced apart slender ribs (64) that make up the downslide (82) can telescope apart behind the traversing bandsaw 32, which is traveling to the left in this view.

FIG. 18 is a top plan view comparable to FIG. 17 except showing that the plurality of spaced apart slender ribs 64 that make up the downslide 82 can telescope apart behind the traversing bandsaw 32, which is traveling to the left in this view.

FIG. 19 is a rear perspective view taken in the direction of arrows XIX-XIX in FIG. 18, wherein the plurality of spaced apart slender ribs 64 that make up the downslide 82 are shown in the fully expanded (open) state.

Figure 20:
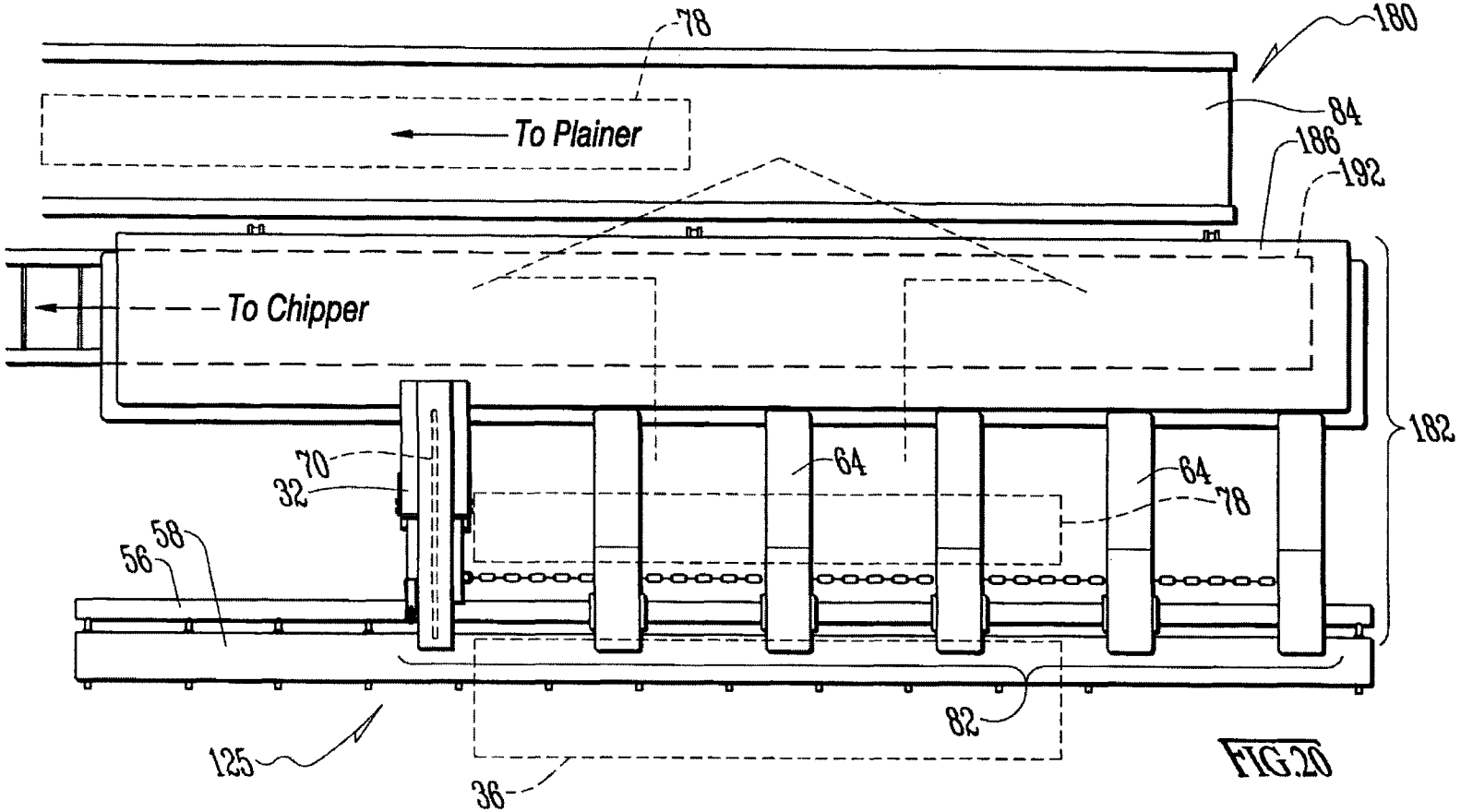
FIG. 20 is a reduced scale top plan view comparable to FIG. 18 except showing not only a closed lid (186) that covers the channel (188) housing for the waste conveyor (192) for waste slices (78) but also showing the production line conveyor (84) for other-than-waste product (78), wherein the plurality of spaced apart slender ribs (64) that make up the downslide (82) are shown in the fully expanded (open) state.

FIG. 20 is a reduced scale top plan view comparable to FIG. 18 except showing not only a closed lid 186 that covers the channel 188 housing for the waste conveyor 192 for waste slices 78 but also showing the production line conveyor 84 for other-than-waste product 78, wherein the plurality of spaced apart slender ribs 64 that make up the downslide 82 are shown in the fully expanded (open) state.

Figure 21:
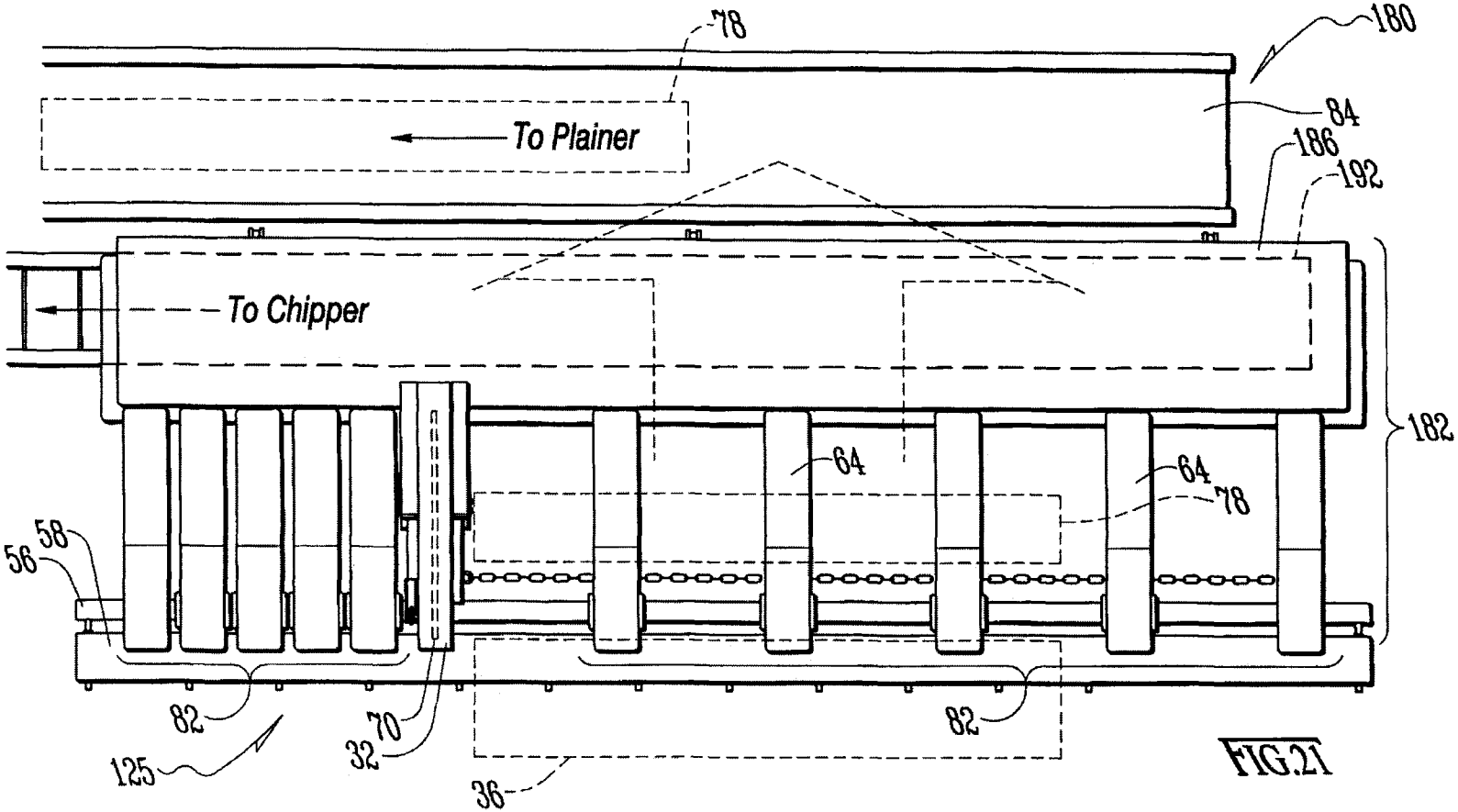
FIG. 21 is a top plan view comparable to FIG. 20 except showing that the outflow conveyor system (180) in accordance with the invention comprises both a left-side downslide (82) and right-side downslide (82), each comprising a plurality of spaced apart slender ribs (64) that can be telescoped between fully expanded (open) extremes, as shown by the right-side downslide (82), and, fully foreshortened (shut) extremes, as shown by the left-side downslide (82), wherein the opposing downslides telescope out to open, and foreshorten back to shut, in opposition to each other and in correspondence with the traverse of the bandsaw (32)

FIG. 21 is a top plan view comparable to FIG. 20 except showing that the outflow conveyor system 180 in accordance with the invention comprises both a left-side downslide 82 and right-side downslide 82. Each downslide 82 comprising a plurality of spaced apart slender ribs 64 that can be telescoped between fully expanded (open) extremes, as shown by the right-side downslide 82, and, fully foreshortened (shut) extremes, as shown by the left-side downslide 82. In use, the opposing downslides 82 telescope out to open, and foreshorten back to shut in opposition to each other and in correspondence with the traverse of the bandsaw 32 back and forth.

Figure 22:
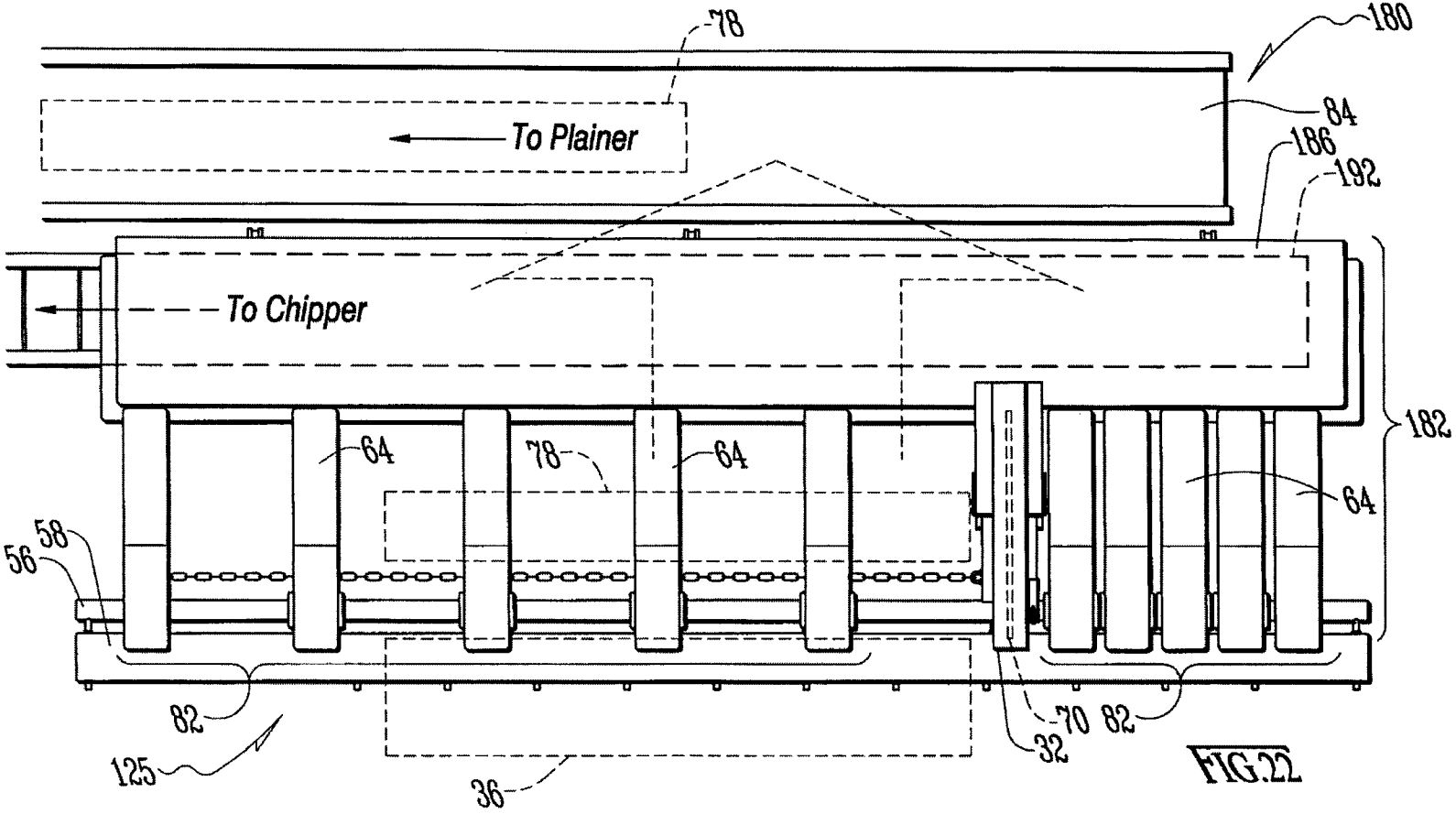
FIG. 22 is a top plan view comparable to FIG. 21 except showing the reverse state of the left- and right-side telescoping downslides (82), wherein the right-side downslide (82) is shown in its fully foreshortened (shut) state and left-side downslide (82) shown in its fully telescoped open state.

FIG. 22 is a top plan view comparable to FIG. 21 except showing the reverse state of the left- and right-side telescoping downslides 82, wherein the right-side downslide 82 is shown in its fully foreshortened (shut) state and left-side downslide 82 shown in its fully telescoped (open) state.

Pause can be taken to summarize various advantages of this sawmill 25 and 125 in accordance with the invention. The rocking carriage 30 alone provides several advantages as explained next.

It should be recalled that, the rocking carriage 30 comprises the log bunk 42, which serves as the primary support deck for a log 36 during saw operations. The log bunk 42 is preferably configured as a spaced plurality of parallel pairs of frames 38. Each parallel pair of frames 38 has a head assembly 50 coupled on top of them to translate over them between forward and rearward extremes. This plurality of head assemblies 50 serve as an upright from the plane of the log bunk 42, and serve as a primary backstop for the log 36 supported on the log bunk 42. Thus the head assemblies 50 collectively define a backstop surface contained in a plane 194 that is more or less perpendicular to the plane of the log bunk 42.

The plane of the log bunk 42 is the plane collectively defined by the spaced plurality of parallel pairs of frames 38 upon which the log 36 is supported.

The rocking carriage 30 is arranged to rock (pivot) clockwise (CW) and counterclockwise (CCW) between angularly spaced extremes about a rocking axis 196 that is substantially spaced below the plane of the support surface of the log bunk 42 (or at least that is, when the plane of log bunk 42 is more or less coincident with level). The plane of the log bunk and the plane 194 of the collective backstop surface of the head assemblies 50 define essentially a perpendicular L-shaped corner.

The rocking carriage 30 rocks back such that this L-shaped corner tips back on its vertex the L-shaped corner, and thereafter essentially can be viewed as a V-shaped trough, albeit a "V" shape where the legs of the "V" are essentially perpendicular to each other. The V-shaped trough can be rocked back until the plane 194 containing the backstop of the head assemblies 50 is only a shallow angle from being level. That way, a fresh log 36 can be fed to the V-shaped trough by simply letting gravity roll the log 36 in (see, eg., FIG. 1, 3 or 14). That way, the rocking carriage 30 can rock back to pick up a fresh log 36 and, other than an infeed conveyor 34, without assistance from any other device or mechanism.

It is preferred if this sawmill 25 and/or 125 is designed to accommodate an inclined bandsaw 32. The bandsaw has a saw blade 70 which runs in an endless loop between a sawing run (eg., straight course) and return run. The plane 72 of the sawing run of the saw blade 70 of the bandsaw 32 might be angled at (for example and without limitation) 22.5° from vertical. Given the foregoing, it is another aspect of the invention that the rocking carriage 30 rocks forwardly until the plane of the log bunk 42 forms a perpendicular angle with the plane 72 of the saw cut of the inclined saw blade 70. If the sawing plane 72 of the saw blade 70 is presumed to make a 22.5° angle with vertical, then accordingly the rocking carriage 30 would rock forward until the plane of the log bunk 42 forms a 22.5° angle with horizontal (not vertical but horizontal). After that, the plurality of head assemblies 50 would incrementally translate forwardly in coordination with each other such that the plane 194 of the backstop surface defined thereby puts the log 36 to-be-sawn out into the path of the saw blade 70 by the selected thickness for the resulting sawn-off slice or plank 78.

Another advantage provided by the rocking carriage 30 includes the following. That is, the rocking carriage 30 can be intermittently rocked back in between selected saw cuts, not all the way back as when picking up a fresh new log 36, but back to where the legs of the V-shaped trough extend at 45° angles to horizontal. That way, the log 36 can be more easily manipulated to be rolled 90° (and as somewhat shown by FIGS. 6 and 7). The plurality collective of head assemblies 50 have dogs 60 (eg., hook projections) that can be driven in endless orbits in both clockwise (CW) and counterclockwise (CCW) directions. The orbit for each dog 60 is approximately a square-D shape or the like, such that the vertical run coincides with running up and down the plane 194 of the backstop defined by the plurality collective of head assemblies 50. The dogs 60 serve at least two different purposes. The primary purpose of the dogs 60 is to "bite" on top of the log 36 such that the log 36 is securely clamped (this is also referred to as "chucked"). This shown in FIGS. 4 and 5. But the dogs 60 can also be driven in a full orbit in reverse such that, when the rocking carriage 30 is tilted back to the 45° angle, the dogs 60 comes in underneath the log 36 and roll it. This is somewhat shown by FIGS. 6 and 7. Preferably this procedure is performed after the log 36 has been sawn once or twice and has at least one flat face. That way, when the dogs 60 come up underneath the log 36, the dogs 36 should knock the log over to roll 90° and land on the log 36's least one flat face. To get the log 36 to roll over, it might take a coordinated movement between the rocking carriage 30 rocking forward, to more or less throw the log 36 over, and running the dogs 60 up beneath behind the log 36, to give the log 36 an extra boost to get it to roll over.

Again, the V-shaped trough defined between the log bunk 42 and head assemblies 50 allows a fresh new log 36 to gently roll off the infeed log deck 34 roll and be caught in the V-shaped trough without another bumper guard. This is shown better in FIG. 14. Additionally, as described above, the V-shaped trough can be rocked back and forth about the 45° angle therefor in combination with (or coordination with) the orbiting dogs 60 to afford an easier means of rolling the sawn log 36 over onto flat faces. Given these two mechanisms (the rocking carriage 30 and its V-shaped trough being one, the reverse-orbiting dogs 60 being the other), users can manipulate the log 36 on the log bunk 42 just about however they want.

It is still another aspect of the invention that ribs 62 of the downslide 82 are angled, configured and otherwise proportioned to ensure that the broad flat face of a sawn off plank 78 lands on the production line conveyor 84 face down, and not face up. This is shown in any of FIGS. 1, 12 and 16. To say this in reverse, it is an aspect of the invention to avoid having the narrow flat face of a sawn off plank 78 land face down. Again, what is wanted is the broad flat face of plank 78 landing face down on production line conveyor 84. In part this is achieved by making the downslide 82 a long slide, and a shallow slide at least at the lower end. Gravity is relied upon to do the work of sliding the sawn-off plank 78 onto the conveyor 84. The conveyor 84 is safely well out of the way of the transverse path of the carriage for the bandsaw 32, because the downslide 82 is a long slide. And, the conveyor 84 should safely catch the plank 78 with the broad face down because the tail of the downslide 82 comes in at a shallow angle. This is shown by any of FIGS. 1, 10, 12, 15 and 16. The downslide 82 is configured to likewise get safely out the way of the traversing bandsaw 32 by comprising a plurality of telescoping ribs 64. Again, gravity does the work of sliding the sawn-off plank 78 out of the way of the transverse path of the carriage for the bandsaw 32. The downslide 32 telescopes out and foreshortens shut with the traversing bandsaw 32 so as to also be safely out of the way.

It is yet another aspect of the invention to provide a telescoping downslide 82 that telescopes between expanding and foreshortening strokes with an inclined bandsaw 32 traversing back and forth. The telescoping downslide 82 enables the sawn-off plank 78 to slide out of the traverse path of the carriage of the bandsaw 32 while keeping itself (the telescoping downslide 82 out of harms way too. It is an aspect to provide such an inventive downslide 82 configuration particularly for an inclined bandsaw 32, regardless if the bandsaw 32 that merely cuts on an out-stroke, and returns without cutting on a return stroke. However, it is even more preferred to provide the bandsaw 32 with a saw blade 70 that has teeth on both edges. That way, the bandsaw 32 can cut on the out-stroke, and then, cut again on the return stroke. It is an aspect of the invention to provide a telescoping downslide 82 on both sides of the traversing bandsaw 32. One telescoping downslide 82 would be undergoing an expansion stroke while the other telescoping downslide 82 would be concurrently undergoing a foreshortening stroke, and vice versa, in alternation with each other.

The invention having been disclosed in connection with the foregoing variations and examples, additional variations will now be apparent to persons skilled in the art. The invention is not intended to be limited to the variations specifically mentioned, and accordingly reference should be made to the appended claims rather than the foregoing discussion of preferred examples, to assess the scope of the invention in which exclusive rights are claimed.

I claim:

1. A sawmill for logs comprising:

a bandsaw mounted on a carriage for traversing between left and right extremes;

a rocking carriage supporting and manipulating a log loaded into the rocking carriage at an elevation above a ground plane during saw operations;

an infeed log deck rearward of the rocking carriage comprising a conveyor supporting a multiplicity of fresh new logs and serially forwarding for the loading of one fresh new log at a time from the multiplicity of logs into the rocking carriage;

an outflow downslide for catching fresh sawn off slices or planks sawn free from the log loaded into the rocking carriage during saw operations;

said racking carriage comprising a log bunk comprising a spaced plurality of frames collectively defining a plane of the log bunk which primarily serves as a support deck for the log loaded into the rocking carriage during saw operation and secondarily serves as a backstop surface for the fresh new log during fresh new log loading operations;

said rocking carriage further comprising plural head assemblies coupled with respect to the log bunk to translate over the plane of the log bunk between forward and rearward extremes;

each head assembly presenting a forward-facing surface that can be individually adjusted to be collectively contained in a plane of the forward-facing surfaces that is generally perpendicular to the plane of the log bunk;

said rocking carriage being arranged to rock forwardly and rearwardly between clockwise and counterclockwise extremes about a rocking axis;

wherein the plane of the log bunk and the plane of the collective forward-facing surfaces of the head assemblies define essentially a perpendicular vertex;

wherein the bandsaw comprises a saw blade which makes saw cuts in a given plane of saw blade cutting travel; and wherein the bandsaw is carried by the carriage therefor such that the given plane of saw blade cutting travel is tilted rearwardly to such an angle from vertical that each fresh sawn off slice or plank sawn free from the log loaded into the rocking carriage during saw operations has a fresh sawn face that lands down on the outflow downslide.

2. The sawmill of claim 1, wherein:

when the plane of the log bunk is adjusted to a 45° angle to horizontal and the head assemblies are retracted to the rearward extremes therefor, the plane of the log bunk and the plane of the collective forward-facing surfaces of the head assemblies define essentially a "V" shape for the vertex;

wherein the rocking axis is disposed substantially spaced away under the plane of the log bunk and generally directly under the vertex when the plane of the log bunk is adjusted to a 45° angle to horizontal and the head assemblies are retracted to the rearward extremes therefor.

3. The sawmill of claim 2, wherein:

said rocking carriage being arranged to rock back to a rearward extreme such that, with the head assemblies retracted to the rearward extremes therefor, the rocking carriage can catch a fresh new log rolling onto the collective forward-facing surfaces of the head assemblies until stopped by the log bunk.

4. The sawmill of claim 3, wherein:

said rocking carriage being arranged to rock back to a rearward extreme such that the plane of the collective forward-facing surfaces of the head assemblies is at an angle that is generally 18° to horizontal whereby the shallower the angle presented lessens the traverse speed of the fresh new log down and across the forward-facing surfaces of the head assemblies as well as thereby reduces the impact at being stopped by the log deck.

5. The sawmill of claim 3, wherein:

said rocking carriage being arranged to rock back to a rearward extreme such that the plane of the collective forward-facing surfaces of the head assemblies is at an angle that is generally 12° to horizontal whereby the shallower the angle presented lessens the traverse speed of the fresh new log down and across the forward-facing surfaces of the head assemblies as well as thereby reduces the impact at being stopped by the log deck.

6. The sawmill of claim 3, wherein:

said rocking carriage being arranged to rock forwardly such that the plane of the log bunk is essentially at an angle complementary to the given plane of saw blade cutting travel, and, the plane of the collective forward-facing surfaces of the head assemblies is essentially parallel to the given plane of saw blade cutting travel.

7. The sawmill of claim 6, wherein:

the bandsaw is carried by the carriage therefor such that the given plane of saw blade cutting travel is tilted rearwardly to essentially a 22.5° angle from vertical.

* * * * *